US009545639B2

(12) United States Patent
Meehan et al.

(10) Patent No.: US 9,545,639 B2
(45) Date of Patent: Jan. 17, 2017

(54) MULTI-FUNCTION WAND ASSEMBLY

(71) Applicant: Delta Faucet Company, Indianapolis, IN (US)

(72) Inventors: Steven Kyle Meehan, Fishers, IN (US); Yilin Tang, Guangzhou (CN); Junxi Lu, Dashi Town (CN)

(73) Assignee: Delta Faucet Company, Indianapolis, IN (US)

( * ) Notice: Subject to any disclaimer, the term of this patent is extended or adjusted under 35 U.S.C. 154(b) by 89 days.

(21) Appl. No.: 14/209,367

(22) Filed: Mar. 13, 2014

(65) Prior Publication Data

US 2014/0263756 A1 Sep. 18, 2014

Related U.S. Application Data

(60) Provisional application No. 61/801,506, filed on Mar. 15, 2013.

(51) Int. Cl.

| | |
|---|---|
| ***B05B 1/16*** | (2006.01) |
| ***B05B 12/00*** | (2006.01) |
| ***B05B 1/18*** | (2006.01) |
| ***E03C 1/04*** | (2006.01) |

(52) U.S. Cl.

CPC ..... *B05B 1/1627* (2013.01); *B05B 1/1681* (2013.01); *B05B 12/002* (2013.01); *B05B 1/18* (2013.01); *E03C 1/0404* (2013.01)

(58) Field of Classification Search

CPC ..... B05B 1/1654; B05B 1/1681; B05B 1/18; B05B 1/12; B05B 1/1627; B05B 12/002; B05B 1/1618; E03C 1/0404; E03C 2001/0415

USPC .... 239/391, 392, 394, 428.5, 442, 443, 444, 239/446, 447, 448, 449, 457, 563, 564, 239/569, 393

See application file for complete search history.

(56) References Cited

U.S. PATENT DOCUMENTS

| | | | | |
|---|---|---|---|---|
| 3,811,619 | A | 5/1974 | Aghnides | |
| 3,967,783 | A | 7/1976 | Halsted et al. | |
| 4,079,891 | A | 3/1978 | Kwan | |
| 4,173,325 | A | 11/1979 | Petrovic | |
| 4,187,986 | A | 2/1980 | Petrovic | |
| 4,190,207 | A | 2/1980 | Fienhold et al. | |
| 4,303,201 | A * | 12/1981 | Elkins | B05B 1/1636 239/381 |
| 4,398,669 | A | 8/1983 | Fienhold | |
| 4,618,100 | A | 10/1986 | White et al. | |
| 4,650,120 | A | 3/1987 | Kress | |
| 4,666,085 | A | 5/1987 | Liaw | |
| 4,703,893 | A | 11/1987 | Gruber | |
| 4,733,818 | A | 3/1988 | Aghnides | |
| 4,733,819 | A | 3/1988 | Aghnides | |
| 4,979,530 | A | 12/1990 | Breda | |

(Continued)

FOREIGN PATENT DOCUMENTS

| | | |
|---|---|---|
| EP | 0 962 256 | 12/1999 |
| EP | 1 132 141 | 9/2001 |

(Continued)

*Primary Examiner* — Arthur O Hall
*Assistant Examiner* — Cody Lieuwen
(74) *Attorney, Agent, or Firm* — Faegre Baker Daniels LLP

(57) ABSTRACT

A faucet wand assembly including a mode diverter and a rotational spray diverter positioned downstream from the mode diverter. The mode diverter is configured to switch between a spray mode and a stream mode, and the spray diverter is configured to change open water outlets in the spray mode.

17 Claims, 31 Drawing Sheets

(56) References Cited

U.S. PATENT DOCUMENTS

| | | | |
|---|---|---|---|
| 5,033,897 | A | 7/1991 | Chen |
| 5,093,943 | A | 3/1992 | Wei |
| 5,145,114 | A | 9/1992 | Monch |
| 5,158,234 | A | 10/1992 | Magnenat et al. |
| 5,172,866 | A | 12/1992 | Ward |
| 5,184,777 | A | 2/1993 | Magnenat et al. |
| 5,199,639 | A | 4/1993 | Kobayashi et al. |
| 5,201,468 | A | 4/1993 | Freier et al. |
| 5,232,162 | A | 8/1993 | Chih |
| 5,398,872 | A | 3/1995 | Joubran |
| 5,433,384 | A | 7/1995 | Chan et al. |
| 5,647,537 | A | 7/1997 | Bergmann |
| 5,772,120 | A | 6/1998 | Huber |
| 5,918,811 | A | 7/1999 | Denham et al. |
| 5,918,816 | A | 7/1999 | Huber |
| 6,076,743 | A | 6/2000 | Fan |
| 6,145,757 | A | 11/2000 | Knapp |
| 6,230,989 | B1 | 5/2001 | Haverstraw et al. |
| 6,247,654 | B1 | 6/2001 | Kuo |
| 6,290,147 | B1 | 9/2001 | Bertrand et al. |
| 6,360,967 | B1 | 3/2002 | Schorn |
| 6,367,710 | B2 | 4/2002 | Fan |
| 6,370,713 | B2 | 4/2002 | Bosio |
| 6,382,529 | B1 | 5/2002 | Wu |
| 6,454,186 | B2 | 9/2002 | Haverstraw et al. |
| 6,454,187 | B1 | 9/2002 | Wang |
| 6,460,782 | B1 | 10/2002 | Wang |
| 6,561,441 | B1 | 5/2003 | Hsieh |
| 6,607,148 | B1 | 8/2003 | Marsh et al. |
| 6,612,507 | B1 | 9/2003 | Meyer et al. |
| 6,622,945 | B1 | 9/2003 | Wu |
| 6,719,219 | B1 | 4/2004 | Wang |
| 6,739,523 | B2 | 5/2004 | Haverstraw et al. |
| 6,742,725 | B1 | 6/2004 | Fan |
| 6,808,130 | B1 | 10/2004 | Ouyoung |
| 6,866,208 | B2 | 3/2005 | Kao |
| 6,938,837 | B2 | 9/2005 | Nelson et al. |
| 7,070,125 | B2 | 7/2006 | Williams et al. |
| 7,216,820 | B2 | 5/2007 | Nelson et al. |
| 7,331,536 | B1 | 2/2008 | Zhen et al. |
| 7,494,074 | B2 * | 2/2009 | Benstead ..... B05B 1/1618 239/11 |
| 7,748,406 | B2 | 7/2010 | Pilatowicz et al. |
| 7,854,401 | B2 | 12/2010 | Malek |
| 7,871,020 | B2 | 1/2011 | Nelson et al. |
| 7,909,269 | B2 | 3/2011 | Erickson et al. |
| 8,448,667 | B2 | 5/2013 | Meehan et al. |
| 2001/0020302 | A1 | 9/2001 | Bosio |
| 2001/0023901 | A1 * | 9/2001 | Haverstraw ..... B05B 1/044 239/443 |
| 2003/0042331 | A1 | 3/2003 | Lu |
| 2004/0164183 | A1 | 8/2004 | Nobili |
| 2004/0217209 | A1 * | 11/2004 | Bui ..... B05B 1/1654 239/548 |
| 2004/0227014 | A1 * | 11/2004 | Williams ..... B05B 1/1618 239/443 |
| 2005/0279864 | A1 | 12/2005 | Fan |
| 2005/0284967 | A1 | 12/2005 | Korb et al. |
| 2006/0016912 | A1 | 1/2006 | Nobili |
| 2006/0022071 | A1 | 2/2006 | Burnworth et al. |
| 2006/0043214 | A1 | 3/2006 | Macan et al. |
| 2007/0170284 | A1 | 7/2007 | Nelson et al. |
| 2010/0065665 | A1 | 3/2010 | Whitaker et al. |
| 2011/0088784 | A1 * | 4/2011 | Meehan ..... E03C 1/0404 137/1 |

FOREIGN PATENT DOCUMENTS

| | | |
|---|---|---|
| GB | 1 452 974 | 10/1976 |
| GB | 2 388 332 | 11/2003 |
| WO | WO 2004/104305 | 12/2004 |
| WO | WO 2005/115554 | 12/2005 |

* cited by examiner

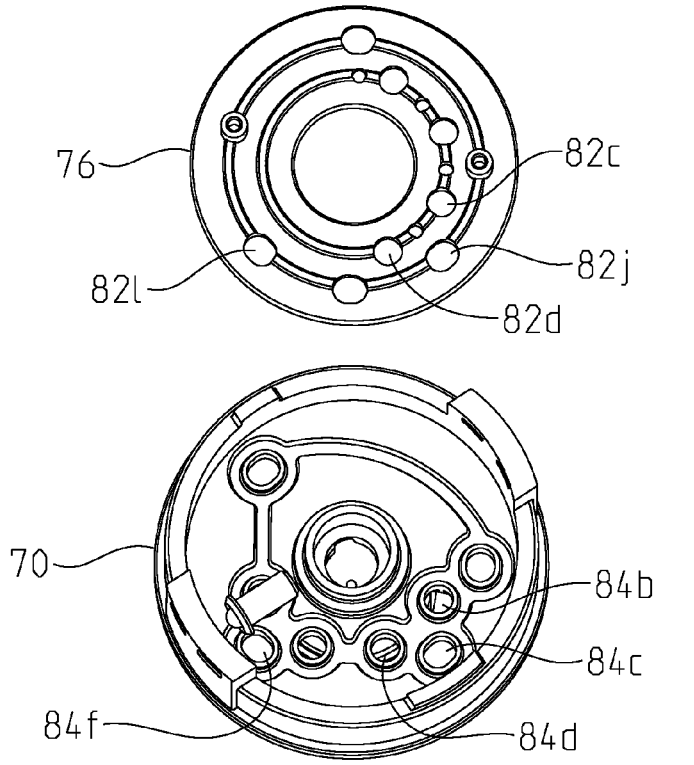
Fig. 21
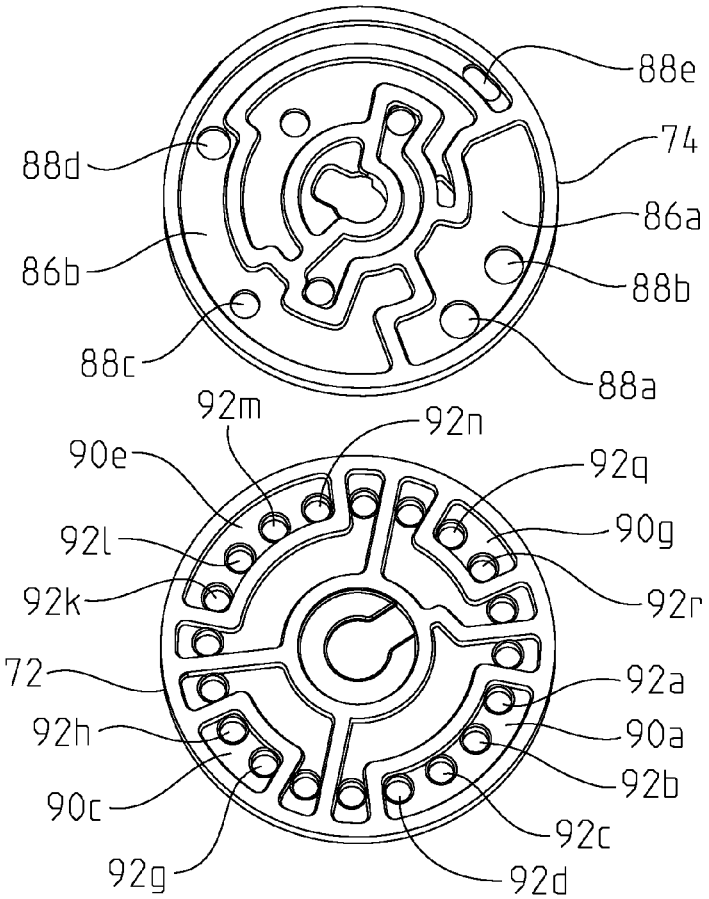

MULTI-FUNCTION WAND ASSEMBLY

CROSS-REFERENCE TO RELATED APPLICATIONS

The present application claims priority to U.S. Provisional Patent Application Ser. No. 61/801,506, filed Mar. 15, 2013, the disclosure of which is expressly incorporated herein by reference.

BACKGROUND AND SUMMARY OF THE DISCLOSURE

The present invention relates generally to faucets and, more particularly, to kitchen faucet wands or sprayheads including diverter to vary operating modes.

Pull-out/pull-down faucet wands or sprayheads are known for use with kitchen faucets. Traditionally, such faucet wands include two functional modes, an aerate mode and a spray mode. In the spray mode, the force of water through the wand sprayface can vary significantly with changes in water pressure. The present invention is configured to allow user to effectively change or customize the force of water in the spray mode by altering the open flow area of the sprayface and, more particularly, the number of active or open outlets dispensing water.

According to an illustrative embodiment of the present disclosure, a faucet wand assembly includes a shell, and a waterway received within the shell, the waterway including an inlet and an outlet. A sprayface is in fluid communication with the waterway and includes a plurality of outlets. A mode diverter is operably coupled to the waterway and is configured to change the fluid flow through the sprayface from a stream mode to a spraymode. A spray diverter is operably coupled to the waterway downstream from the mode diverter and is configured to change the active water outlets in the spray mode.

According to another illustrative embodiment of the present disclosure, a faucet wand assembly includes a shell, and a waterway received within the shell. The waterway includes an inlet and an interface member including a plurality of interface openings. A sprayface is fluidly coupled to the waterway. A rotational spray diverter is operably coupled to the waterway and includes a distribution member. The distribution member includes a plurality of distribution inlet ports, a plurality of distribution outlet ports, and a plurality of runners fluidly coupling the distribution inlet ports and the distribution outlet ports. The distribution member is configured to rotate relative to the interface member of the waterway, wherein the distribution inlet ports are selectively alignable with different interface openings as the distribution member rotates relative to the interface member.

According a further illustrative embodiment, a faucet wand assembly includes a waterway, mode diverter including a piston received within the waterway to toggle between a spray mode and a stream mode, and a rotational spray diverter positioned downstream of the mode diverter and rotatable relative to the waterway. In a first rotational orientation the spray diverter is in a first spray mode where a first set of water outlets in the sprayface are open, in a second rotational orientation the spry diverter is in a second spray mode where a second set of water outlets are open, and in a third rotational orientation the spray diverter is in a third spray mode where a third set of water outlets are open. The first set of water outlets is greater than the second set of water outlets, and the second set of water outlets is greater than the third set of water outlets.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 21 is an exploded perspective view illustrating the fluid paths of the rotational spray diverter in the fourth mode of FIG. 15;

DETAILED DESCRIPTION OF THE DRAWINGS

The embodiments of the invention described herein are not intended to be exhaustive or to limit the invention to precise forms disclosed. Rather, the embodiments elected for description have been chosen to enable one skilled in the art to practice the invention.

Figure 1:
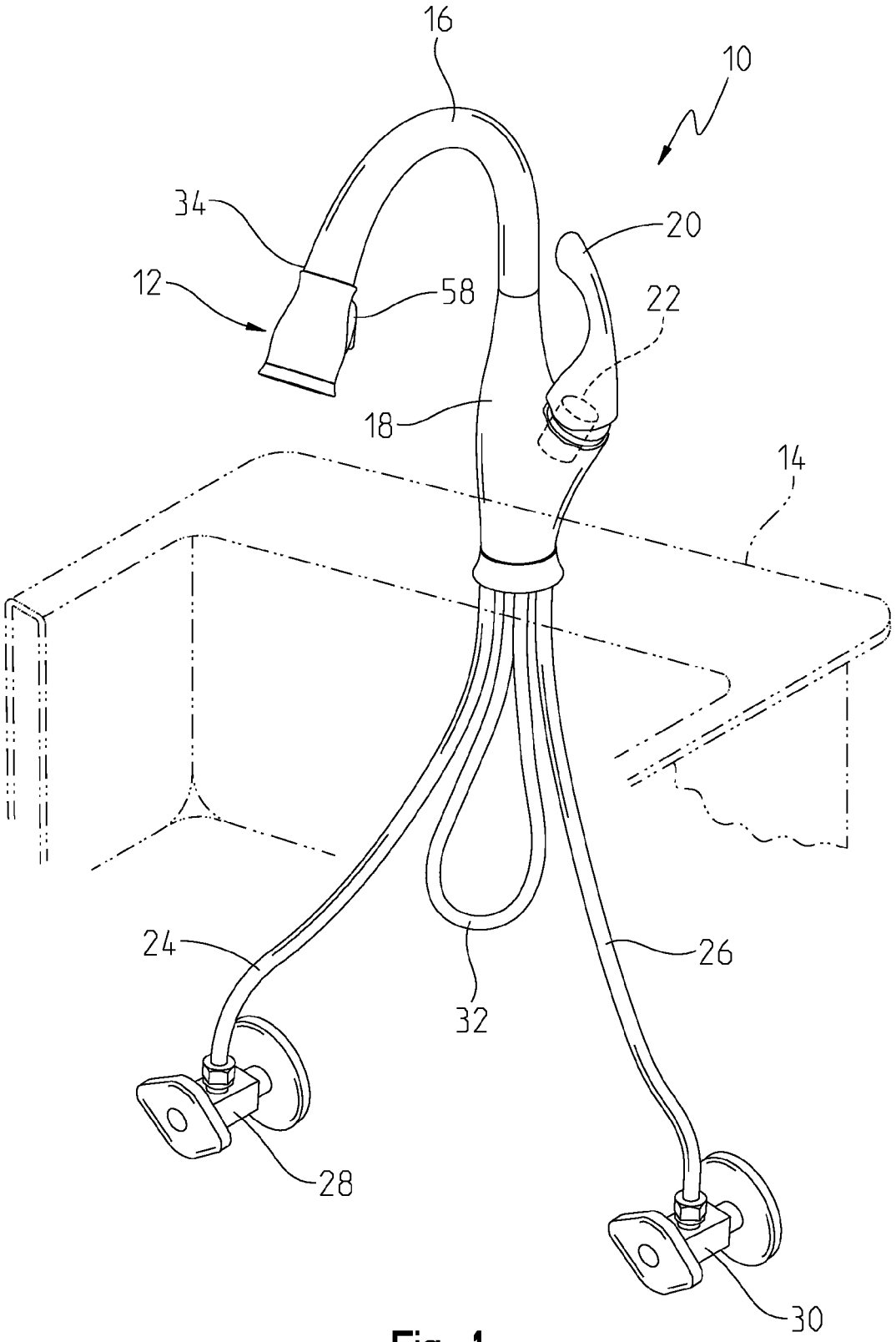
FIG. 1 is a perspective view of a faucet including an illustrative sprayhead of the present disclosure and mounted to a sink deck.
Figure 2:
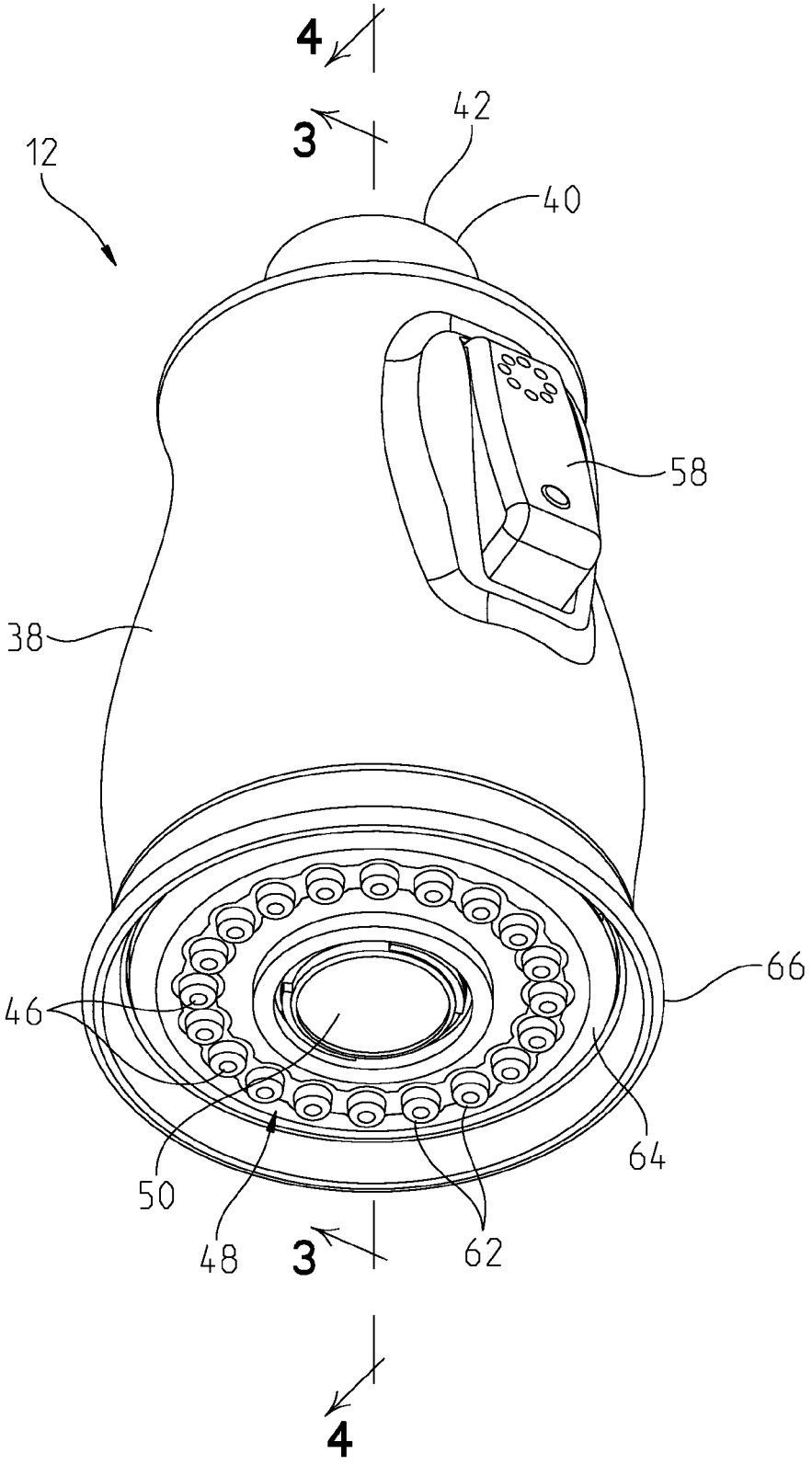
FIG. 2 is a perspective view of the illustrative sprayhead of FIG. 1.

With reference initially to FIG. 1, an illustrative faucet 10 including a sprayhead 12 of the present disclosure is shown mounted to a sink deck 14. The faucet 10 illustratively includes a delivery spout 16 supported by a hub 18. A handle 20 may be supported by the hub 18 and is illustratively operably coupled to a manual mixing valve 22 to control water flow to the sprayhead 12. More particularly, a hot water supply tube 24 and a cold water supply tube 26 fluidly couple the mixing valve 22 to hot and cold water supplies, illustratively stops 28 and 30. A flexible outlet tube 32 fluidly couples an outlet of the mixing valve 22 to the sprayhead 12 and extends through the hub 18 and delivery spout 16.

The sprayhead 12 may be removably coupled to an outlet 34 of the delivery spout wherein the outlet tube 32 is slidably received within the delivery spout 16 and the hub 18. A coupler 36 may be used to releasably secure the sprayhead 12 to the outlet 34 of the delivery spout 16. Such a releasable coupler 36 may include a magnet, a bayonet coupler, or spring-biased fingers.

With reference now to FIGS. 2-6, the sprayhead illustratively includes an outer shell 38 receiving a waterway 40. A fastener, such as screw 39 may secure the outer shell 38 to the waterway 40. The waterway 40 includes a threaded inlet 42 fluidly coupled to the outlet tube 32. Check valves 43 may be supported downstream from the inlet 42. A mode diverter 44 is supported by the waterway 40 and is configured to toggle fluid flow between a spray mode and a stream mode. In the spray mode, water is dispersed through outlet openings 46 in a sprayface 48. In a stream mode, water is dispensed through an aerator 50. A spray diverter 52 is rotationally coupled to the shell 38 and positioned downstream from the mode diverter 44. The spray diverter 52 operates only in the spray mode and is configured to change the cumulative cross-sectional flow area of outlet openings 46 dispensing water through sprayface 48.

Figure 3:
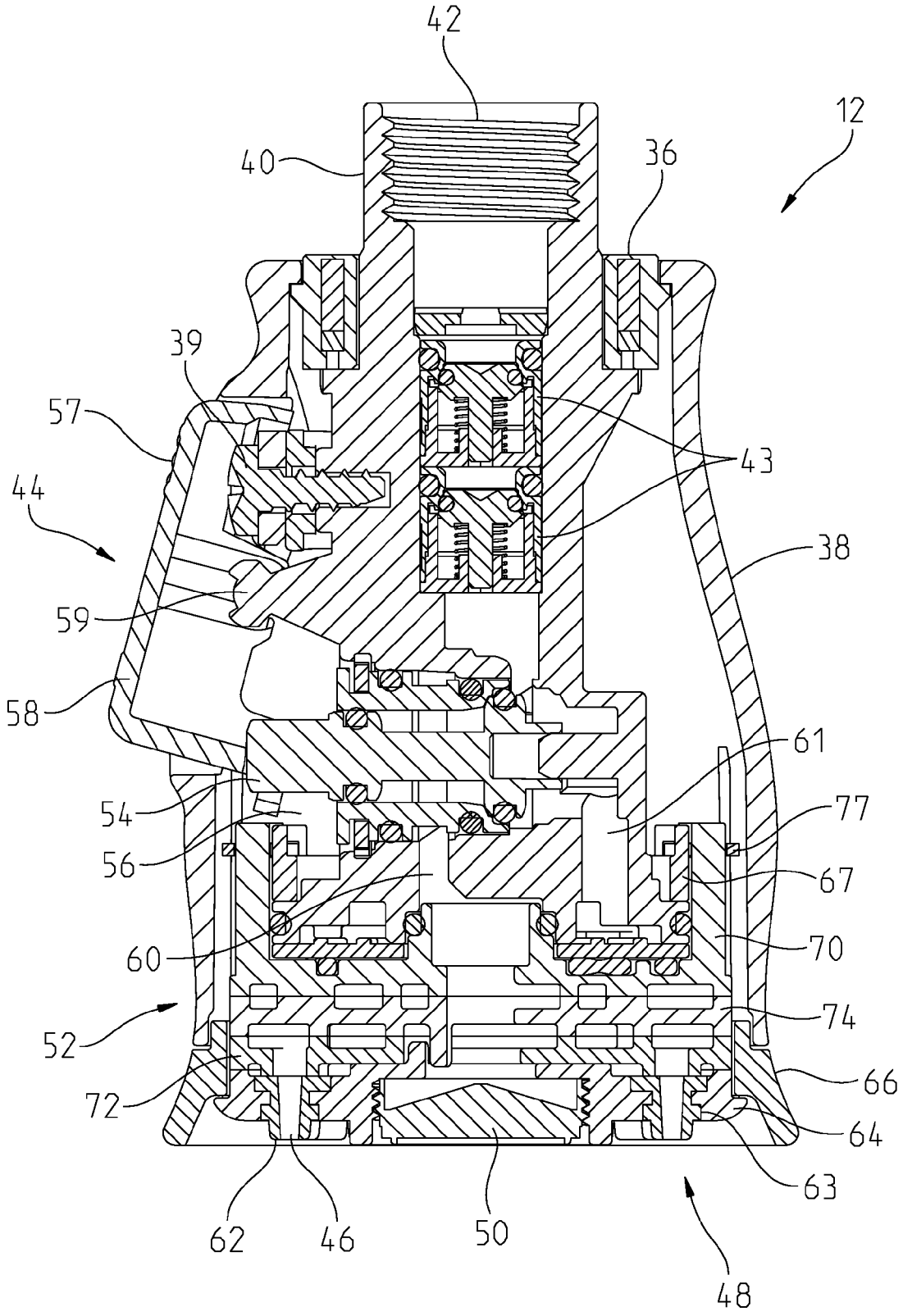
FIG. 3 is a cross-sectional view taken along line 3-3 of FIG. 2.
Figure 4:
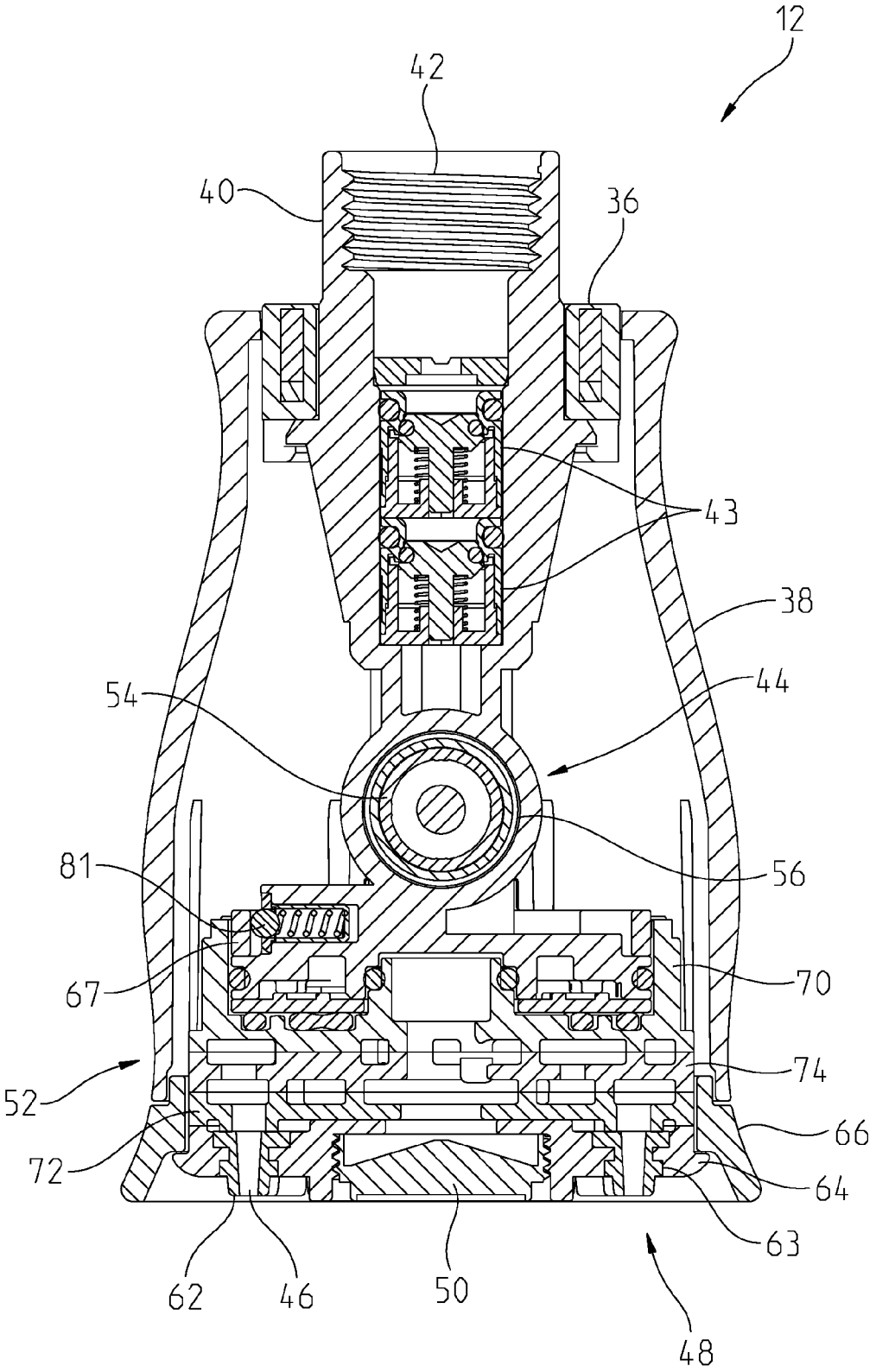
FIG. 4 is a cross-sectional view taken along line 4-4 of FIG. 2.
Figure 5:
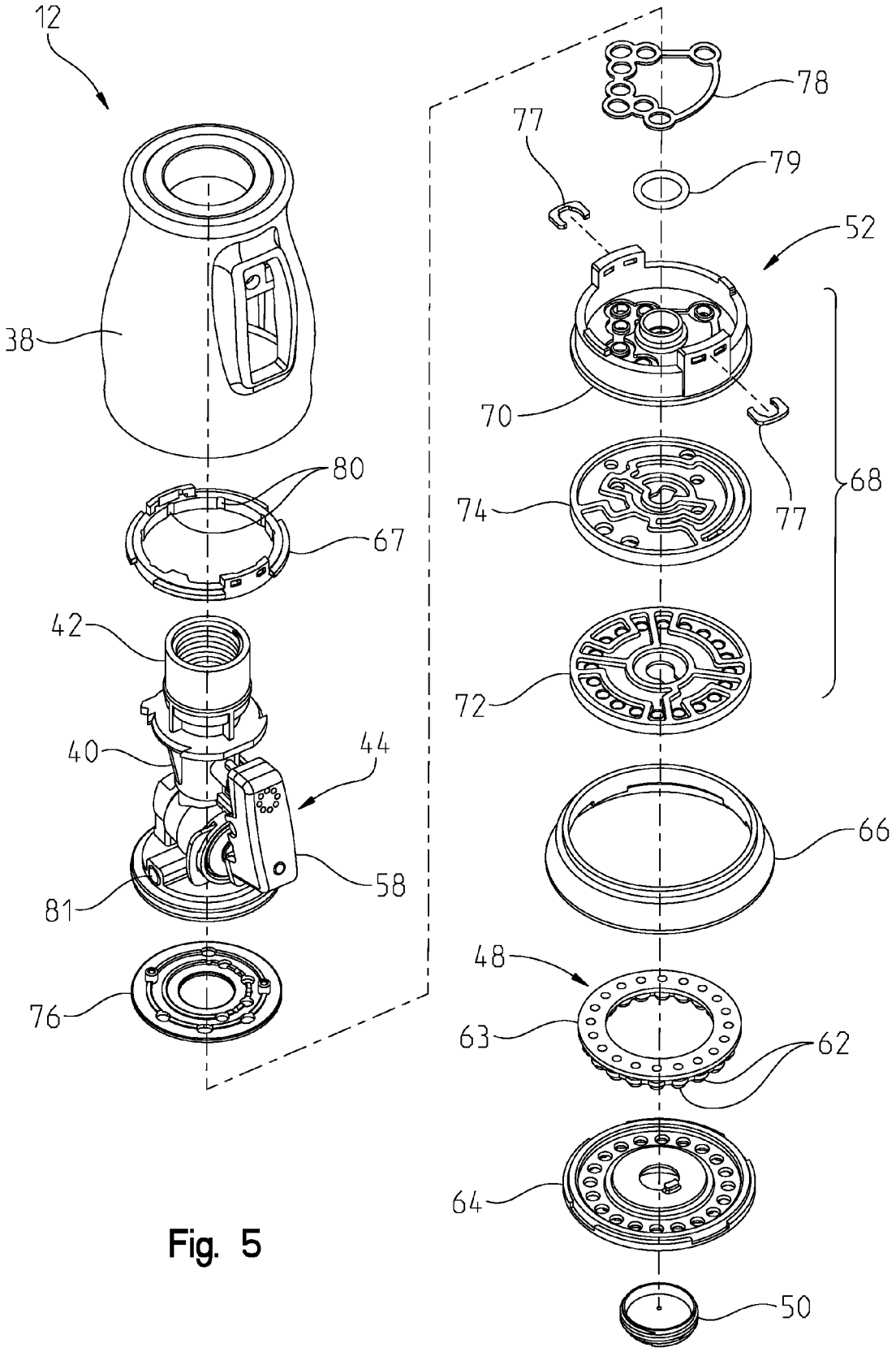
FIG. 5 is an upper exploded perspective view of the sprayhead of FIG. 2.
Figure 6:
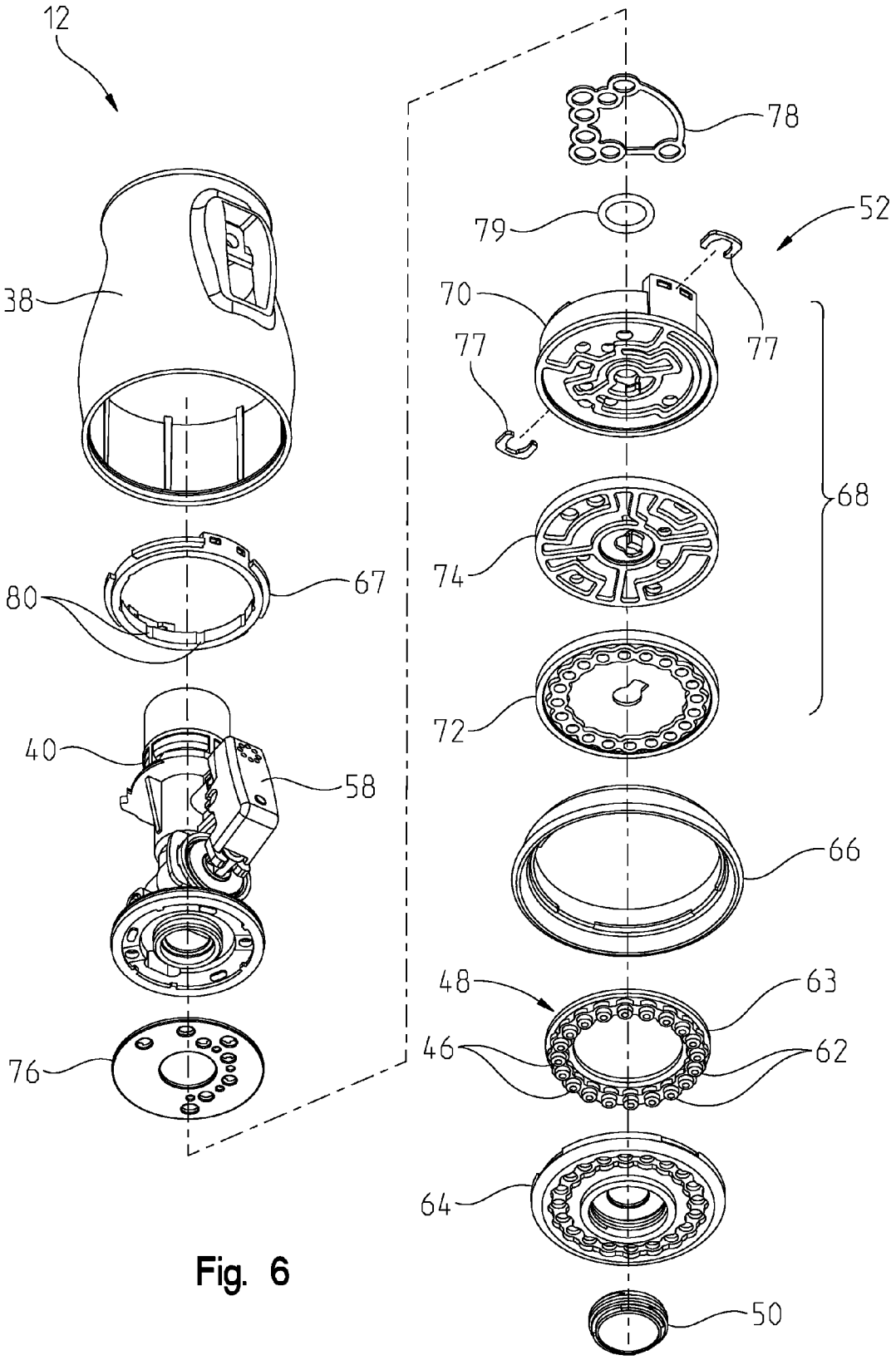
FIG. 6 is a lower exploded perspective view of the sprayhead of FIG. 2.
Figure 8:
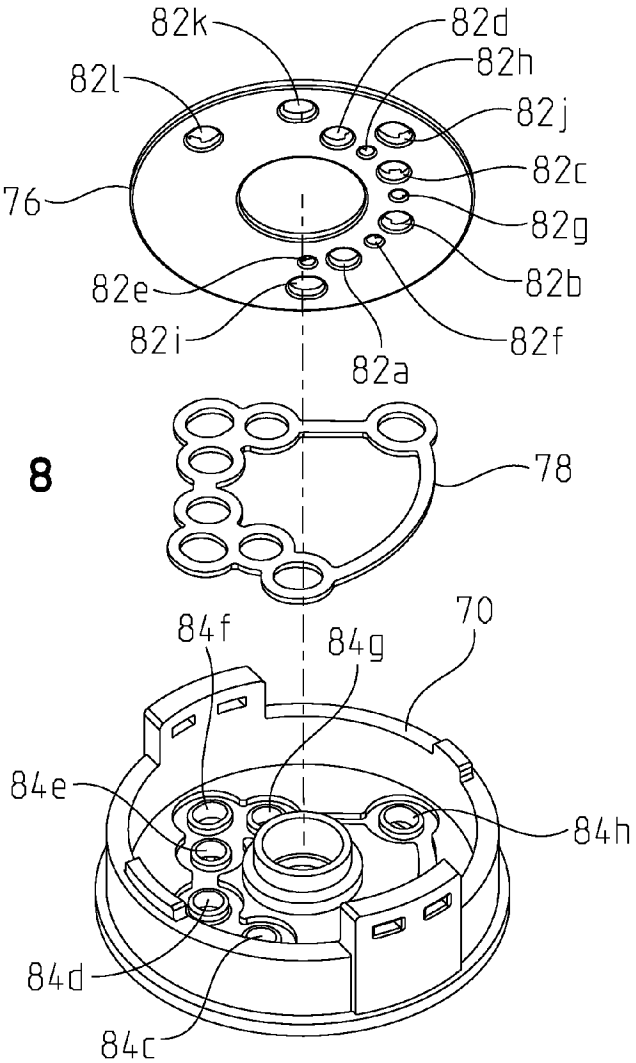
FIG. 8 is a detailed exploded perspective view of the sprayhead of FIG. 2, showing the interface plate, the gasket and the upper distribution member.
Figure 7:
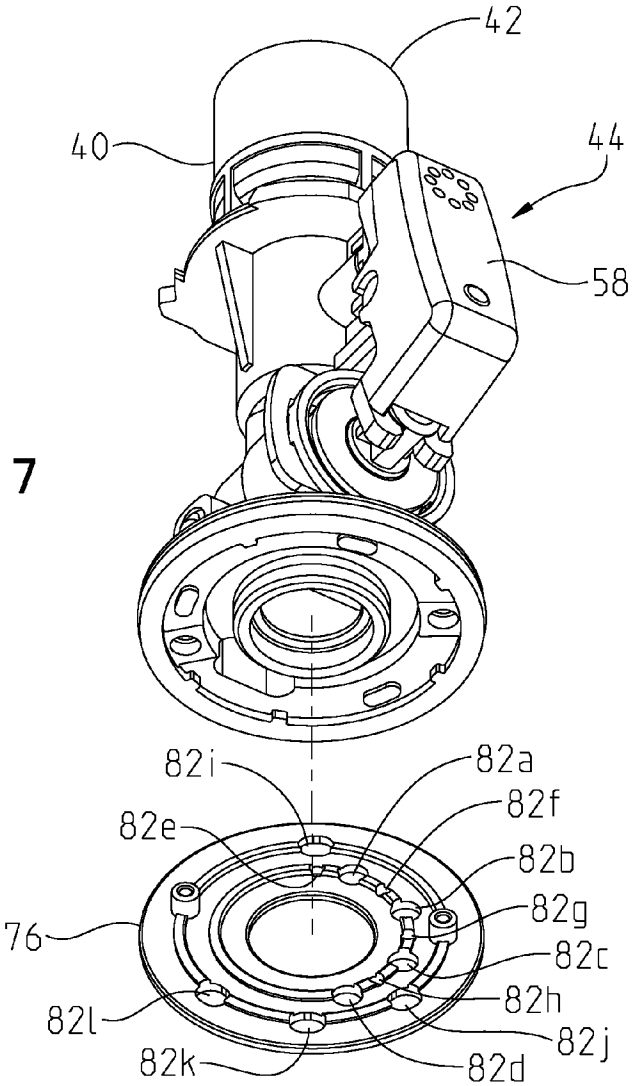
FIG. 7 is a detailed exploded perspective view of the sprayhead of FIG. 2, showing the waterway and the interface plate.
Figure 10:
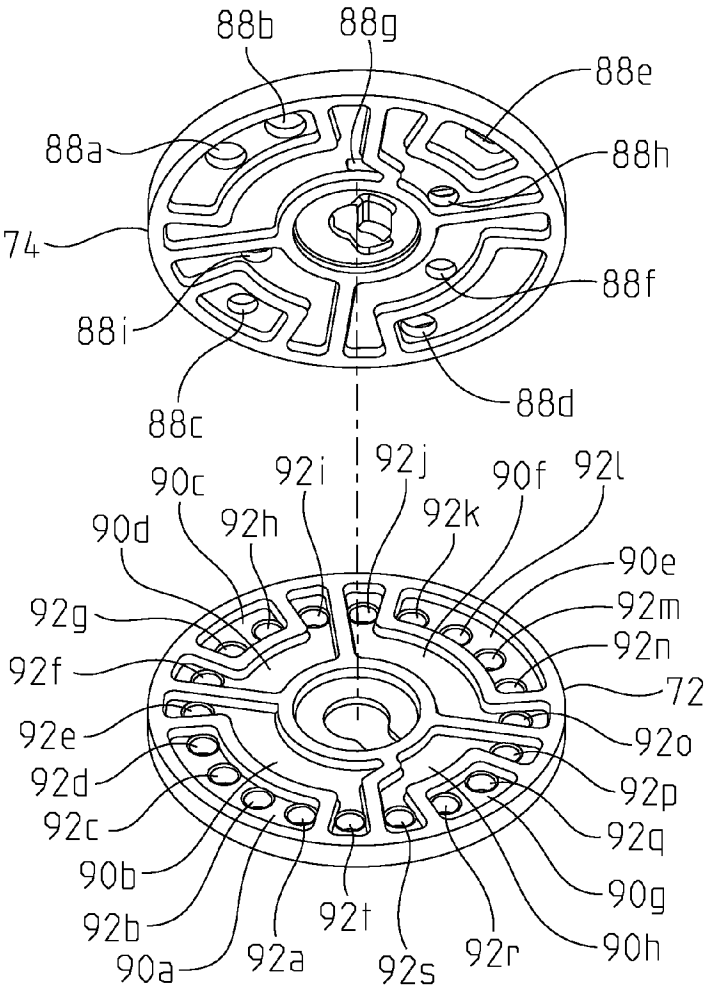
FIG. 10 is a detailed exploded perspective view of the sprayhead of FIG. 2, showing the intermediate distribution member and the lower distribution member.
Figure 9:
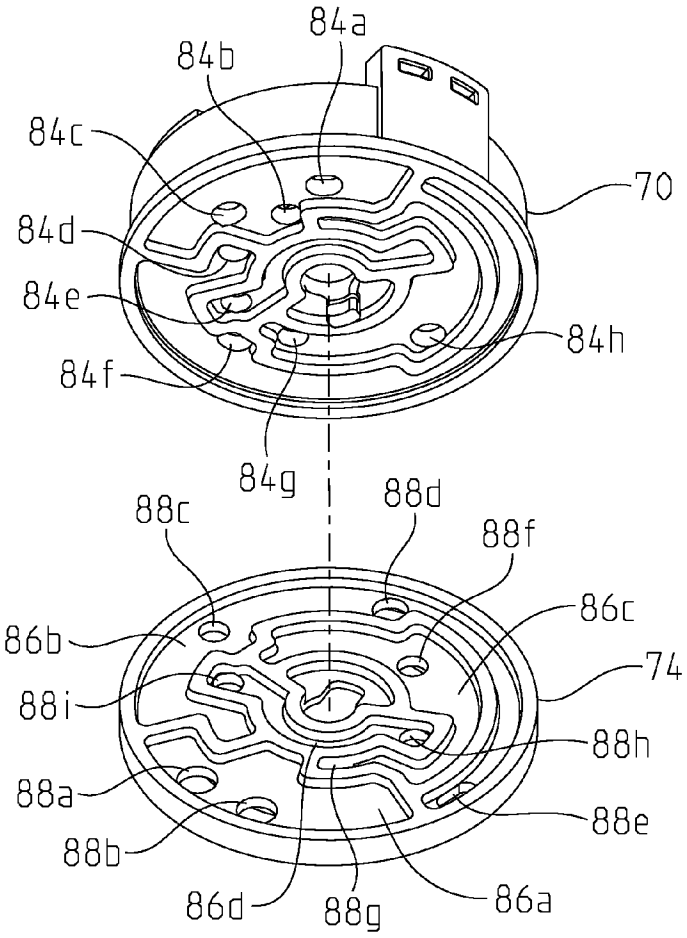
FIG. 9 is a detailed exploded perspective view of the sprayhead of FIG. 2, showing the upper distribution member and the intermediate distribution member.
Figure 11:
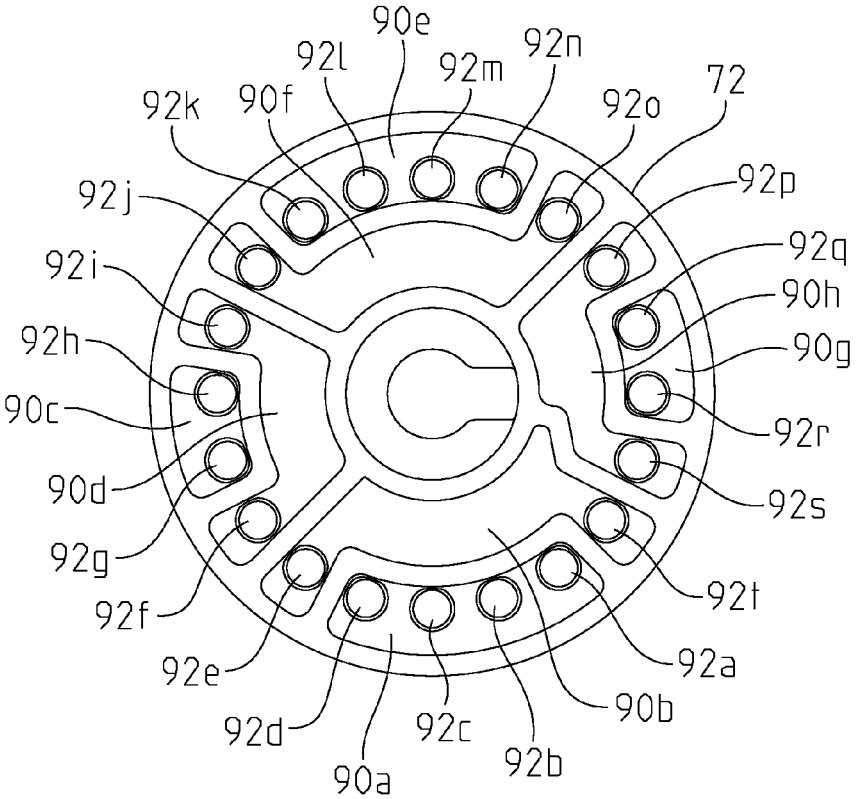
FIG. 11 is a top plan view of the lower distribution member.

The mode diverter 44 may be of conventional design as including a piston 54 slidably received with in a chamber 56 of the waterway 40. A toggle switch 58 is operably coupled to the piston 54. The toggle switch 58 may include a rocker button 57 supported for rocking or pivoting about a pivot ball 59 (FIG. 3). User input to the toggle switch 58 causes the piston 54 to alternate between the spray mode and the stream mode. In a first position, the piston 54 directs water from inlet 42 through a passageway 60 to aerator 50 (i.e. stream mode). In a second position, the piston 54 directs water to a second chamber 61 and to the spray diverter 52 (i.e., spray mode).

The sprayface 48 illustratively includes a plurality of nozzles 62 supported within an annular body or ring 63 and defining outlet openings 46. In the illustrative embodiment, the nozzles 62 and respective outlet openings 46 are circumferentially spaced apart from each other in the pattern of an annular ring. A holder 64 receives the ring 63 and is axially retained to shell 38 by lower ring 66. The spray diverter 52 is rotatably supported within the shell 38 by the waterway 40, and is axially secured to the waterway 40 by a retaining ring 67.

With reference to FIGS. 5-8, a distribution assembly 68 includes an upper distribution member or plate 70, a lower distribution member or plate 72, and an intermediate distribution member or plate 74. The upper distribution member 70 is configured to rotationally interface with an interface plate 76 supported by the outlet end of the waterway 40. A gasket 78 is received intermediate the interface plate 76 and the upper distribution member 70. Similarly, an o-ring 79 is supported intermediate the waterway 40 and the upper distribution member 70. The retaining ring 67 is coupled to the upper distribution member 70 through a pair of clips 77. The retaining ring 67 includes a plurality of recesses 80 that cooperate with a ball detent 81 and provides for positive rotational positioning of the spray diverter 52 in the various modes as further detailed herein.

Referring now to FIGS. 7-11, the waterway interface 76 includes a plurality of interface openings **82*a*-82*d* that are configured to be in selective communication with inlet ports or openings 84*a*-84*h* in the upper distribution member 70. Inlet ports 84*a*-84*h* of the upper distribution member 70 are in fixed fluid communication with fluid channels or runners 86*a*-86*d* defined between the upper distribution member 70 and the intermediate distribution member 74. These runners 86*a*-86*d*, in turn, are in fixed fluid communication with connecting ports 88*a*-88*i* in the intermediate distribution member 74. Connecting ports 88*a*-88*i* are in fixed fluid communication with fluid channels or runners 90*a*-90*h* defined between intermediate distribution member 74 and lower distribution member 72. Outlet ports 92*a*-92*t* in the lower distribution member 72 are in direct and fixed fluid communication with runners 90*a*-90*h* and with outlet openings 46 defined by the sprayface 64**.

Figure 12:
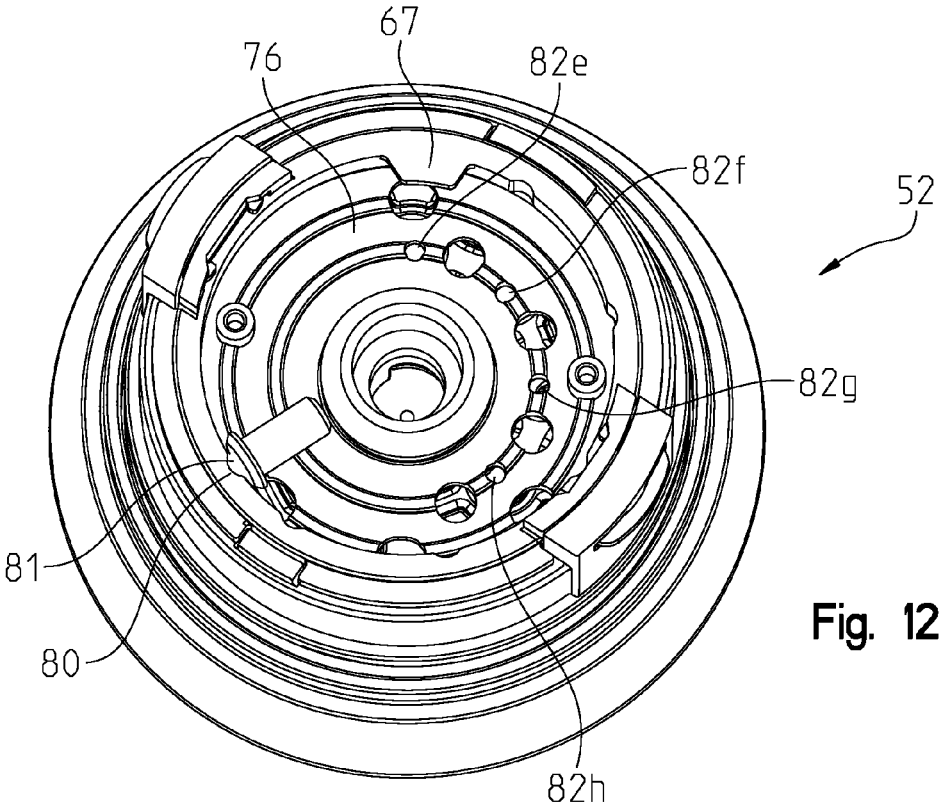
FIG. 12 is an upper perspective view illustrating the rotational spray diverter in a first mode.
Figure 16:
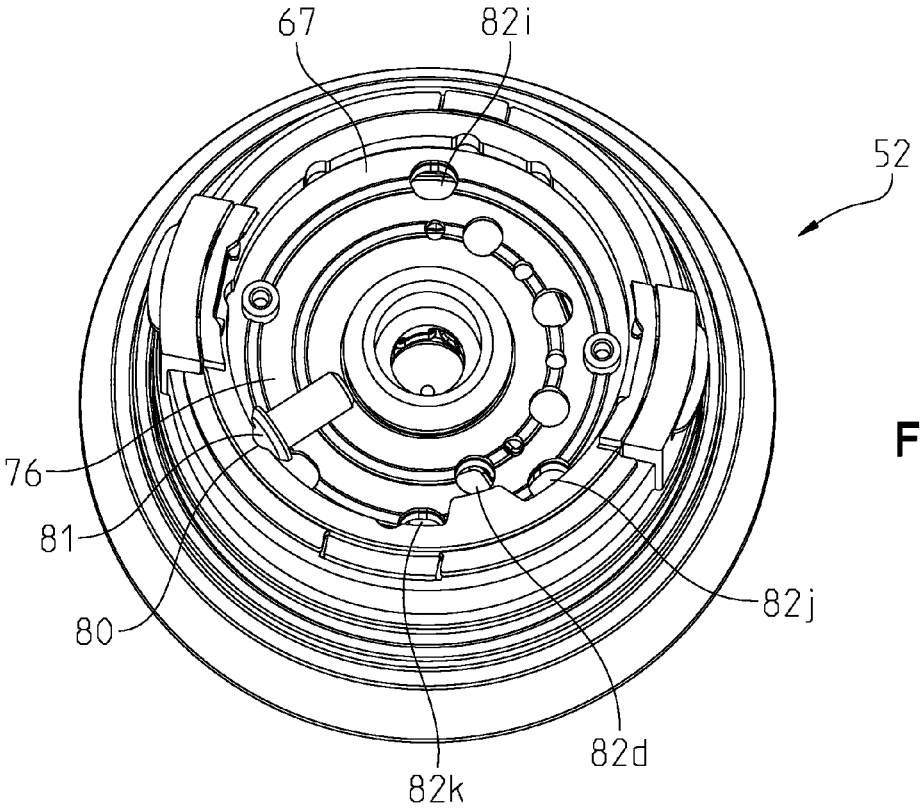
FIG. 16 is an upper perspective view illustrating the rotational spray diverter in a fifth mode.
Figure 17:
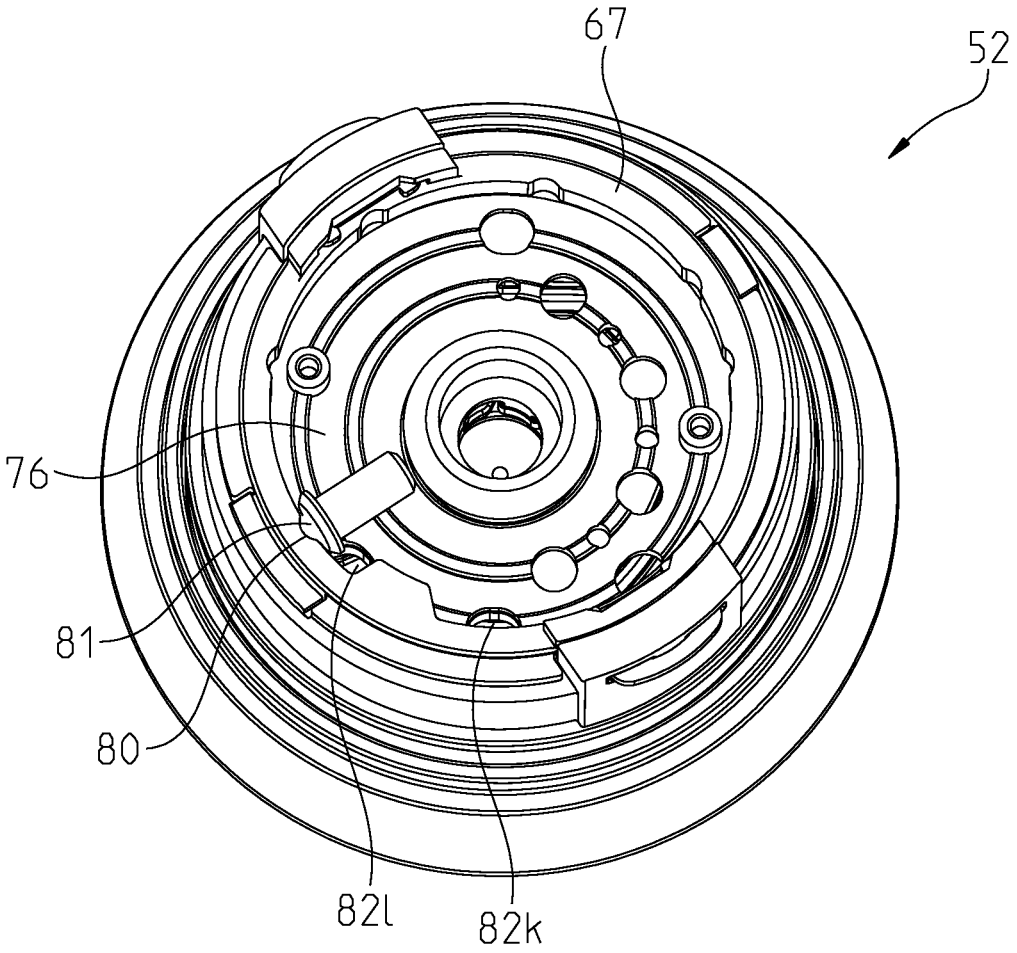
FIG. 17 is an upper perspective view illustrating the rotational spray diverter in a sixth mode.
Figure 18:
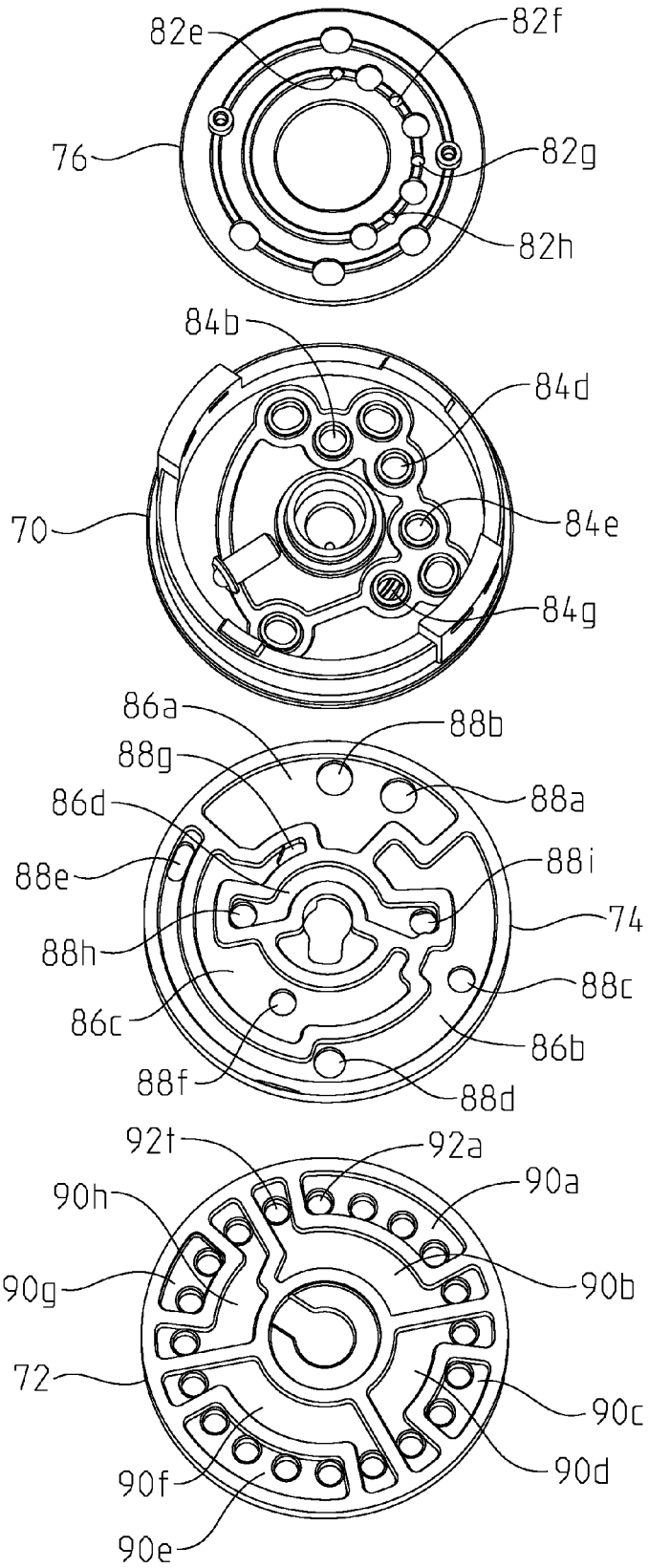
FIG. 18 is an exploded perspective view illustrating the fluid paths of the rotational spray diverter in the first mode of FIG. 12.

With further reference now to FIGS. 12-23, various angular positions and associated modes of operation of the spray diverter 52 are shown. In different modes of operation, various circumferential groups of openings 46 in the sprayface 64 may be active or dispensing water. FIGS. 12 and 18 represent the spray diverter 52 in a first mode of operation. In this mode of operation, all openings 92*a*-92*t* in the lower distribution member 72 and corresponding openings 46*a*-46*t* in the sprayface 64 are active or in fluid communication with the inlet 42 of the waterway 40.

With further reference to FIGS. 12 and 18, a first or home position of the spray diverter 52 associated with the first mode of operation is illustrated. In this position, all openings 92*a*-92*t* of the distribution member 72 and corresponding openings 46*a*-46*t* of the sprayface 64 are open with a low flow rate of water dispensed therefrom. More particularly, openings 82*e*, 82*f*, 82*g*, 82*h* of the waterway interface 76 are in fluid communication with openings 84*b*, 84*d*, 84*e*, 84*g* of the upper distribution member 70. In turn, openings 84*b*, 84*d*, 84*e*, 84*g* of the upper distribution member 70 are in fluid communication with runners 86*a*, 86*b*, 86*c*, 86*d*, intermediate the upper distribution member 70 and the intermediate distribution member 74. These runners 86*a*, 86*b*, 86*c*, 86*d* are in communication with connecting ports 88*a*-88*i* which, in turn, are in communication with runners 90*a*, 90*b*, 90*c*, 90*d*, 90*e*, 90*f*, 90*g*, 90*h* between the intermediate distribution member 74 and the lower distribution member 72. These runners 90 provide communication with all of the openings 92*a*-92*t* in the lower distribution member 72 which, in turn, are in fluid communication with all of the outlets 46*a*-46*t* of the sprayface 64.

Figure 13:
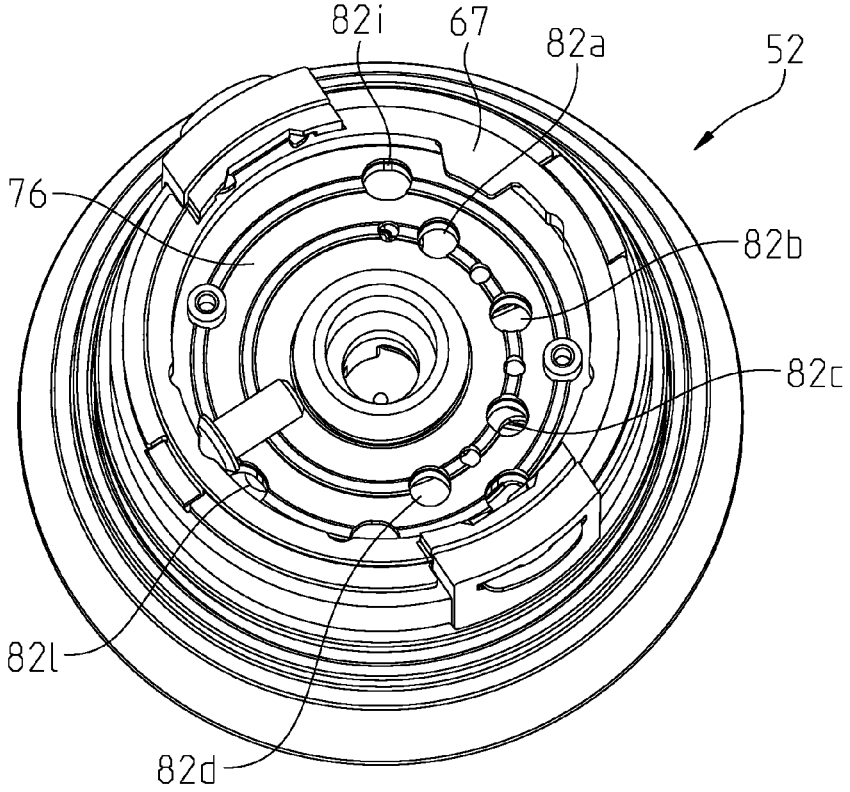
FIG. 13 is an upper perspective view illustrating the rotational spray diverter in a second mode.
Figure 19:
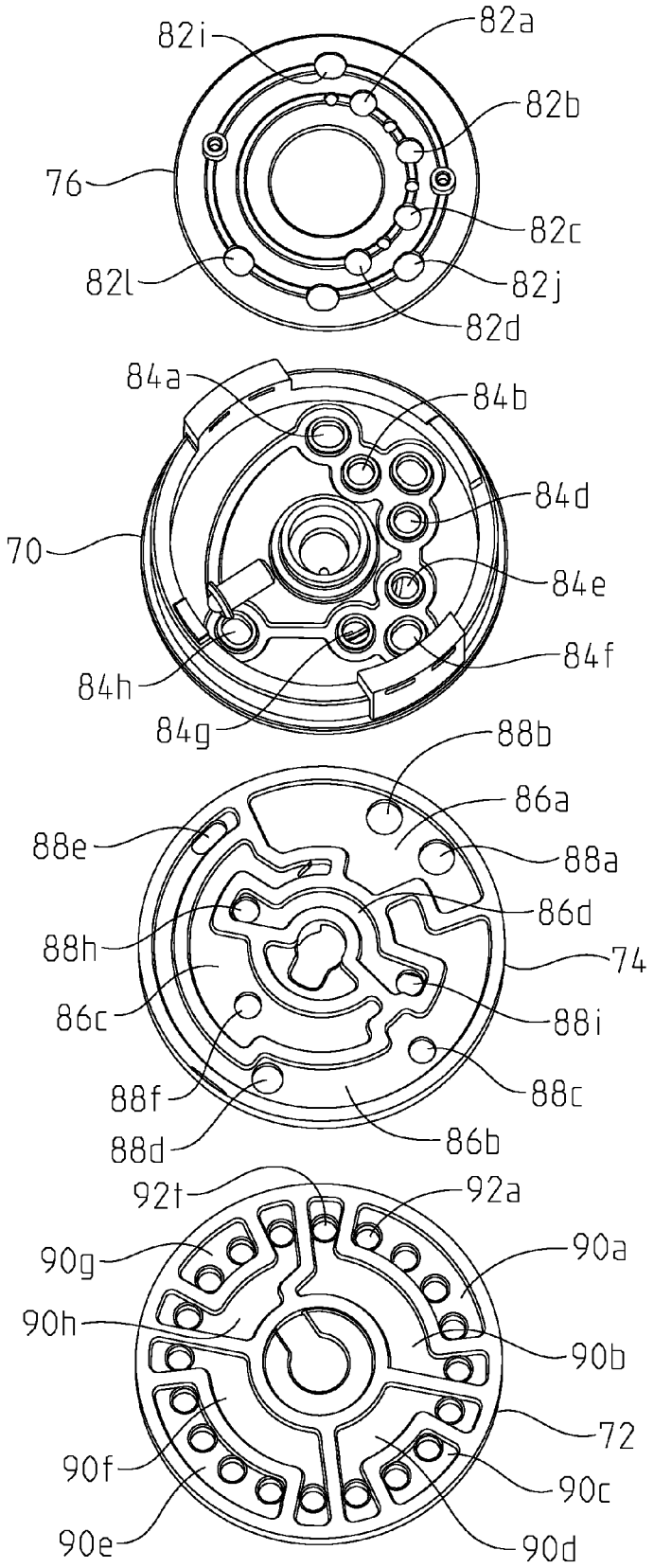
FIG. 19 is an exploded perspective view illustrating the fluid paths of the rotational spray diverter in the second mode of FIG. 13.

FIGS. 13 and 19 illustrate the spray diverter 52 rotated clockwise by approximately 22.5 degrees from the first position of FIG. 12. In this position, the spray diverter 52 provides for a second mode of operation where all of the openings 92*a*-92*t* in the lower distribution member 72 and corresponding openings 46*a*-46*t* in the sprayface 64 are open with a high flow rate of water dispensed therefrom.

With further reference to FIG. 19, in the second mode of operation, openings 82*a*, 82*b*, 82*c*, 82*d*, 82*i*, 82*j*, 821 of the waterway interface 76 are in fluid communication with openings 84*a*, 84*b*, 84*d*, 84*e*, 84*d*, 84*g*, 84*h* of the upper distribution member 70 of the spray diverter 52. Openings 84*a*, 84*b*, 84*d*, 84*e*, 84*d*, 84*g*, 84*h* are in fluid communication with runners 86*a*, 86*b*, 86*c*, 86*d* intermediate the upper distribution member 70 and the intermediate distribution member 74. Runners 86*a*, 86*b*, 86*c*, 86*d* are in fluid communication with connecting ports 88*a*-88*i* which, in turn, are in communication with runners 90*a*-90*h* between the intermediate distribution member 74 and the lower distribution member 72. As such, all of the openings 92*a*-92*t* in the lower distribution member 72 are open to provide fluid to the outlets 46*a*-46*t* in the sprayface 64. It is noted that the openings 82*a*, 82*b*, 82*d*, 82*e*, 82*g*, 82*h* provide a greater cross-sectional flow area than the openings 82*e*, 82*f*, 82*g*, 82*h* in the first mode. As such, the flow rate is greater in the second mode than in the first mode.

Figure 14:
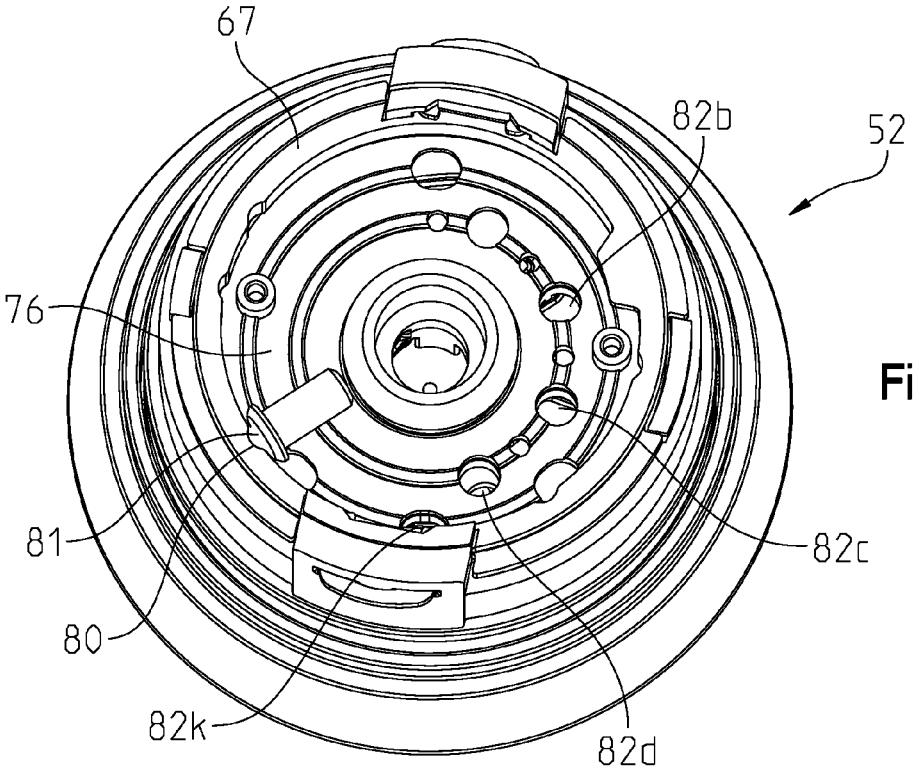
FIG. 14 is an upper perspective view illustrating the rotational spray diverter in a third mode.
Figure 20:
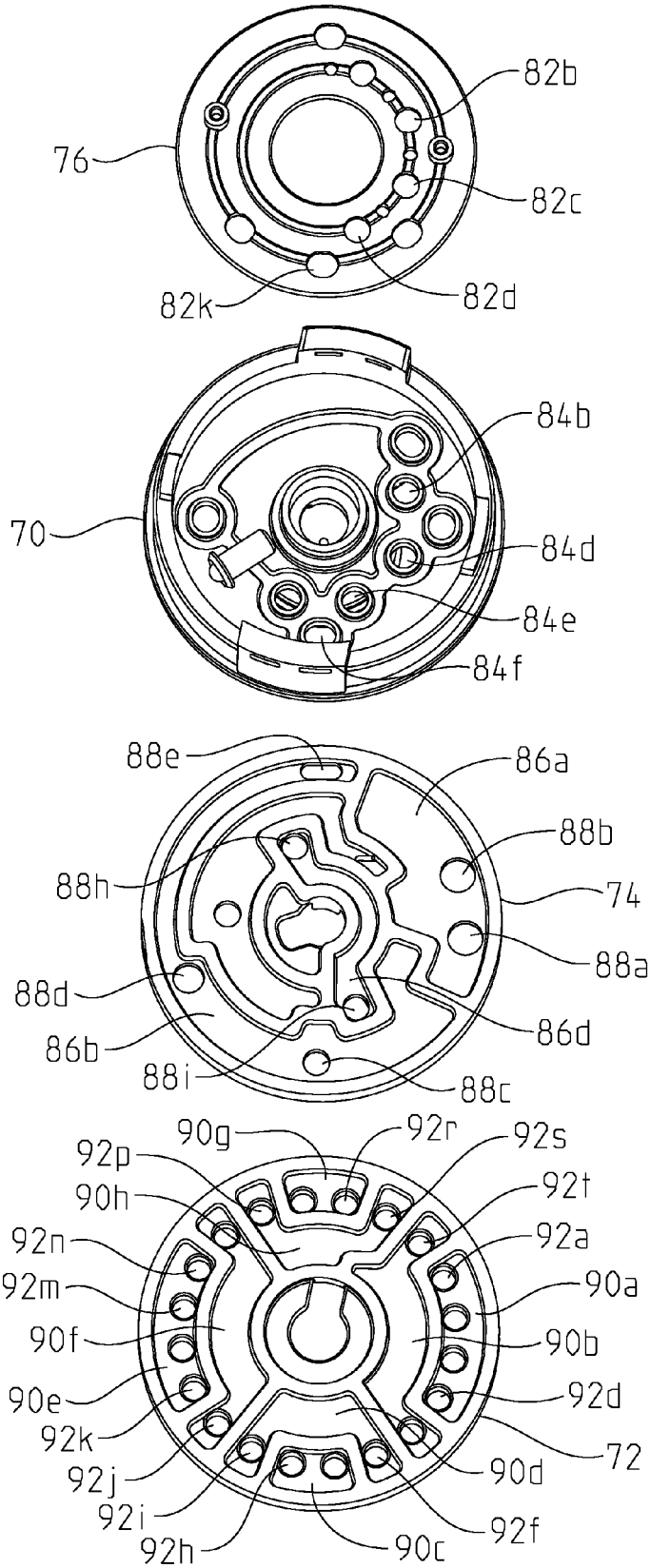
FIG. 20 is an exploded perspective view illustrating the fluid path of the rotational spray diverter in the third mode of FIG. 14.

Turning now to FIGS. 14 and 20, a third mode of operation is illustrated as showing the spray diverter 52 rotated 45 degrees clockwise from the position of FIG. 13. In other words, the total rotation of the spray diverter 52 from the position of FIG. 12 is approximately 67.5 degrees clockwise. In this third mode of operation, all but four outlets 92*e*, 92*j*, 92*o*, 92*t* in the lower distribution member 72 and corresponding outlets 46*e*, 46*j*, 46*o*, 46*t* in the sprayface 64 are open and dispensing water.

With further reference to FIG. 20, in the third mode of operation, openings 82*b*, 82*c*, 82*d*, 82*k* of waterway interface 76 are in fluid communication with openings 84*b*, 84*d*, 84*e*, 84*f* of the upper distribution member 70. Openings 84*b*, 84*d*, 84*e*, 84*f* are in fluid communication with runners 86*a*, 86*b*, 86*d* intermediate the upper distribution member 70 and the intermediate distribution member 74. Runners 86*a*, 86*b*, 86*d* are in fluid communication with connecting ports 88*a*, 88*b*, 88*c*, 88*d*, 88*e*, 88*h*, 88*i* which, in turn, are in communication with runners 90*a*, 90*c*, 90*d*, 90*e*, 90*g*, 90*h* between the intermediate distribution member 74 and the lower distribution member 72. As such, openings 92*a*-92*d*, 92*f*-92*i*, 92*k*-92*n*, 92*p*-92*s* and corresponding outlets 46*a*-46*d*, 46*f*-46*i*, 46*k*-46*n*, 46*p*-46*s* of the sprayface 64 are open for dispensing water.

Figure 15:
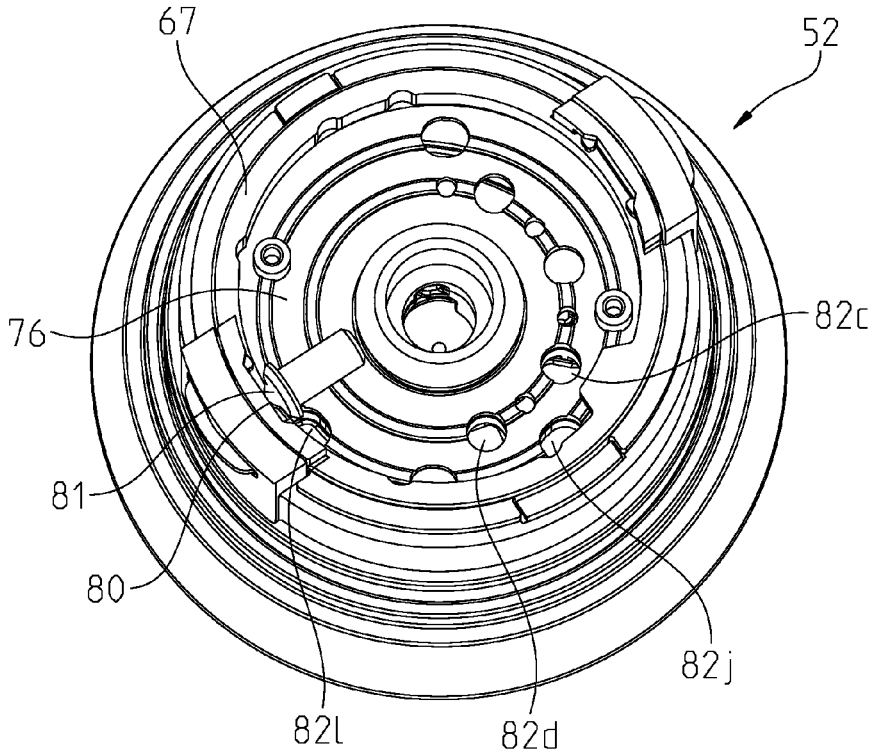
FIG. 15 is upper perspective illustrating the rotational spray diverter in a fourth mode.

With reference now to FIGS. 15 and 21, a fourth mode of operation is shown where the spray diverter 52 is rotated 45 degrees clockwise from the position of FIG. 14. In other words, the spray diverter 52 is positioned approximately 112.5 degrees clockwise from the position of FIG. 12. In this mode, all but eight of the openings 92*e*, 92*f*, 92*i*, 92*j*, 92*o*, 92*p*, 92*s*, 92*t* in the lower distribution member 72 and corresponding openings 46*e*, 46*f*, 46*i*, 46*j*, 46*o*, 46*p*, 46*s*, 46*t* in the sprayface 64 are open for dispensing water.

With reference to FIG. 21, in the fourth mode of operation, openings 82*c*, 82*d*, 82*j*, 821 of the waterway interface 76 are in fluid communication with openings 84*b*, 84*c*, 84*d*, 84*f* of the upper distribution member 70. In turn, these openings 84*b*, 84*c*, 84*d*, 84*f* are in fluid communication with runners 86*a*, 86*b* intermediate the upper distribution member 70 and the intermediate distribution member 74. Runners 86*a*, 86*b* are in fluid communication with connecting ports 88*a*, 88*b*, 88*c*, 88*d*, 88*e* and with the runners 90*a*, 90*c*, 90*e*, 90*g* between the intermediate distribution member 74 and the lower distribution member 72. As such, outlets 92*a*-92*d*, 92*g*, 92*h*, 92*k*-92*n*, 92*q*, 92*r* are open and in fluid communication with corresponding outlets 46*a*-46*d*, 46*g*, 46*h*, 46*k*-46*n*, 46*q*, 46*r* at the sprayface 64.

Figure 22:
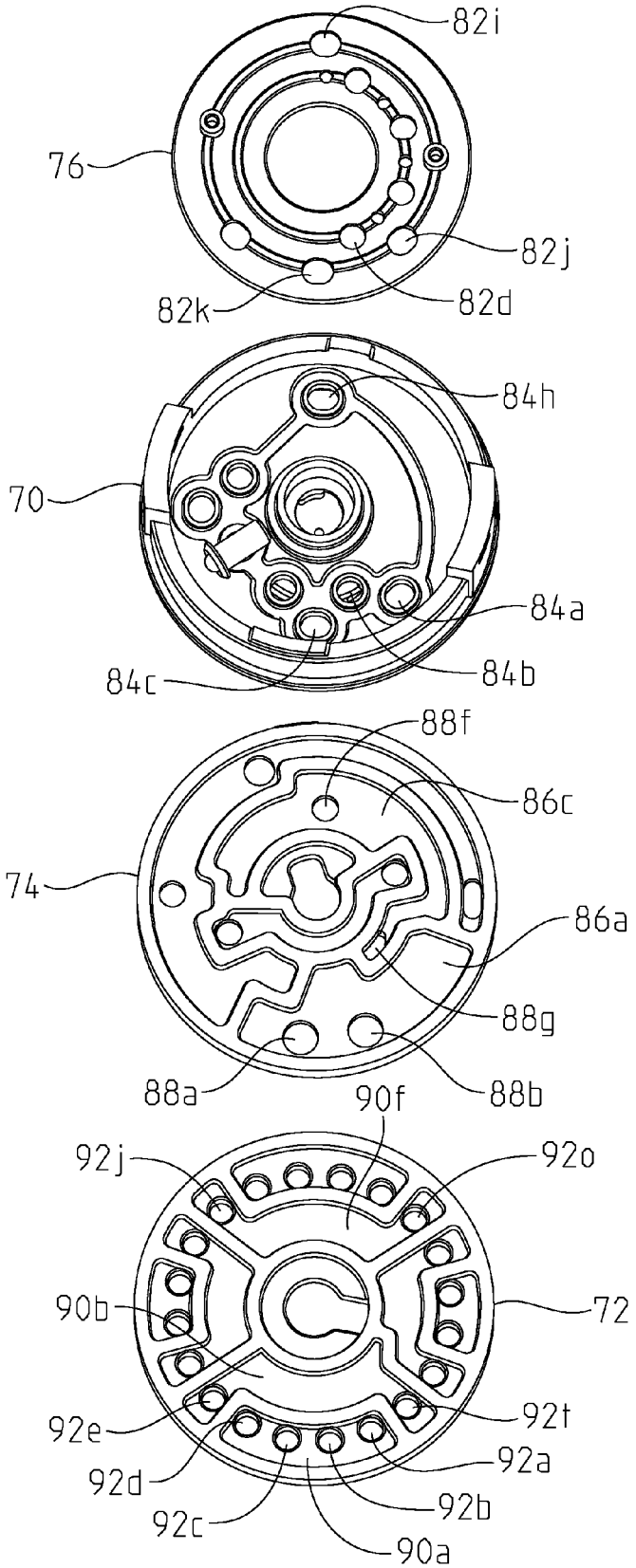
FIG. 22 is an exploded perspective view illustrating the fluid as of the rotational spray diverter in the fifth mode of FIG. 16.

With reference now to FIGS. 16 and 22, a fifth mode of operation is shown where the spray diverter 52 is rotated 45 degrees clockwise from the position of FIG. 15. In other words, the spray diverter 52 is shown rotated approximately 157.5 degrees clockwise from the position of FIG. 12. In this mode, eight openings 92*a*-92*e*, 92*j*, 92*o*, 92*t* in the lower distribution member 72 and corresponding outlets 46*a*-46*e*, 46*j*, 46*o*, 46*t* in the sprayface 64 are open for dispensing water.

With reference to FIG. 22, in the fifth mode of operation, openings 82*d*, 82*i*, 82*j*, 82*k* of the waterway interface 76 are in fluid communication with openings 84*a*, 84*b*, 84*c*, 84*h* of the upper distribution member 70. In turn, these openings 84*a*, 84*b*, 84*c*, 84*h* are in fluid communication with runners 86*a*, 86*c* intermediate the upper distribution member 70 and the intermediate distribution member 74. Runners 86*a*, 86*c* are in fluid communication with connecting ports 88*a*, 88*b*, 88*f*, 88*g* and with the runners 90*a*, 90*b*, 90*f* between the intermediate distribution member 74 and the lower distribution member 72. As such, outlets 92*a*-92*d*, 92*e*, 92*j*, 92*o*, 92*t* are open and in fluid communication with corresponding outlets 46*a*-46*d*, 46*e*, 46*j*, 46*o*, 46*t* at the sprayface 64.

Figure 23:
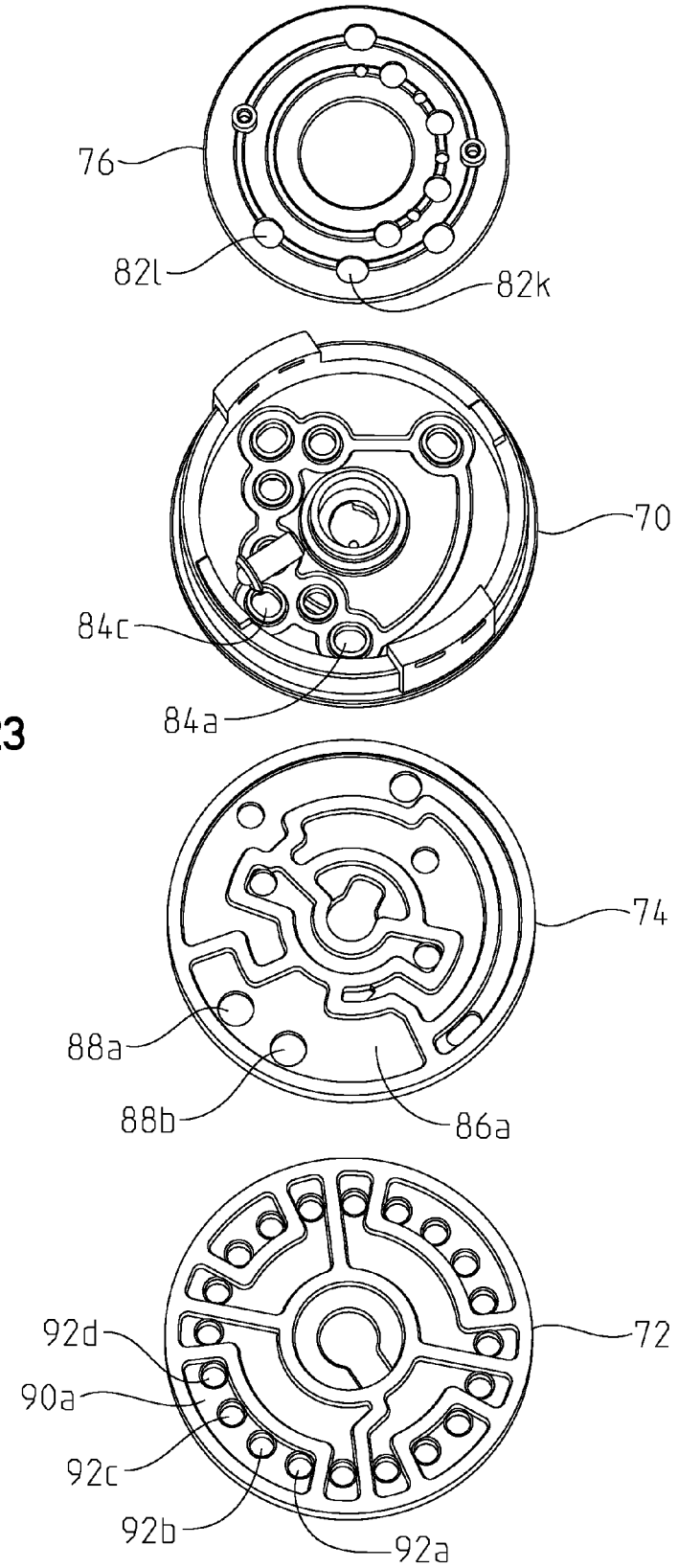
FIG. 23 is an exploded perspective view illustrating the fluid as of the rotational spray diverter in the sixth mode of FIG. 17.
Figure 24:
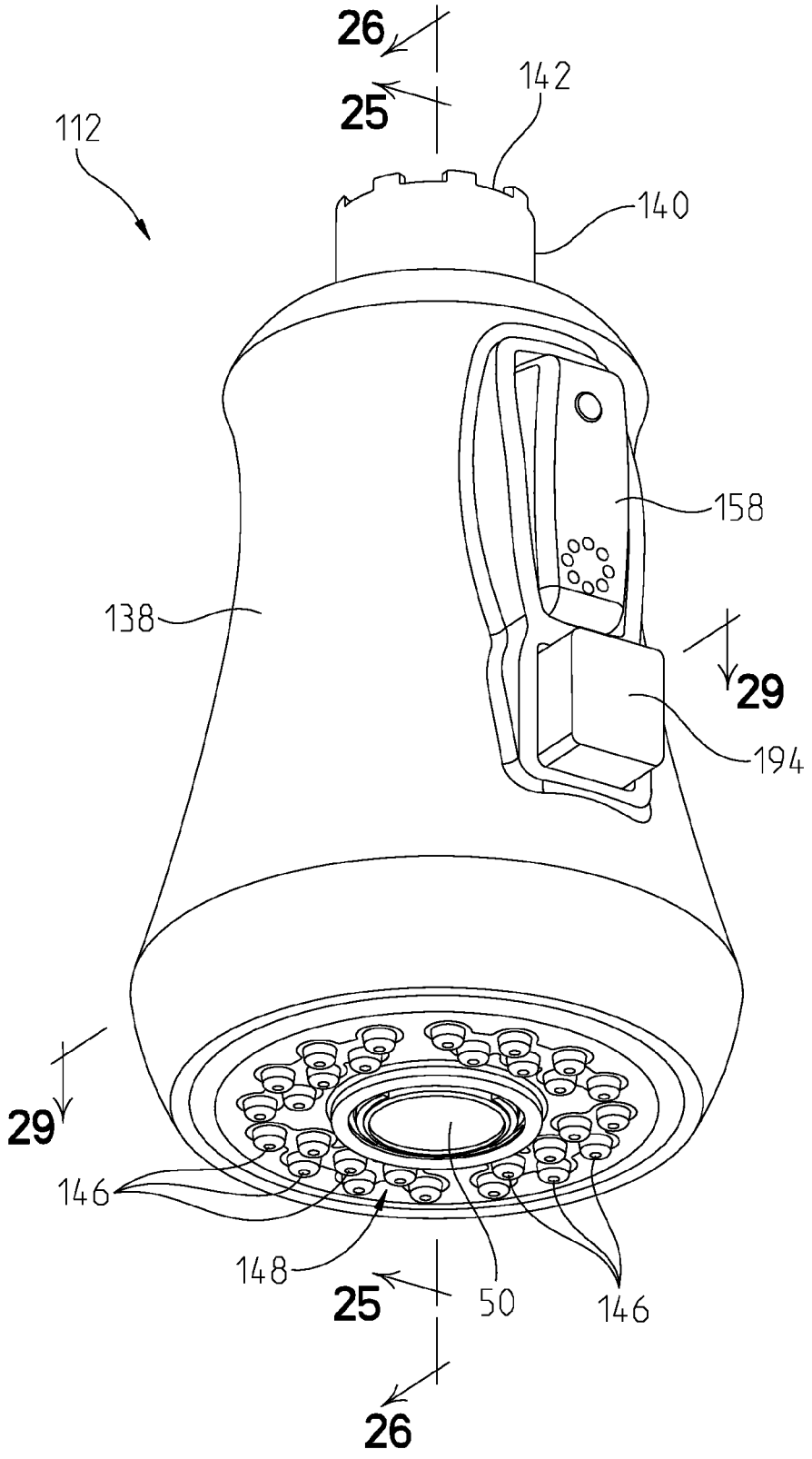
FIG. 24 is a perspective view of a further illustrative sprayhead of the present disclosure.

With reference to FIGS. 17 and 23, a sixth mode of operation of the spray diverter 52 is shown where the spray diverter 52 is rotated 45 degrees clockwise from the position FIG. 16. In other words, spray diverter 52 is shown rotated approximately 202.5 degrees clockwise from the position of FIG. 12. In the mode illustrated in FIG. 23, four openings 92*a*-92*d* in the lower distribution member 72 and corresponding openings 46*a*-46*d* in the sprayface 64 are open.

With reference to FIG. 23, in the sixth mode of operation, openings 82*k*, 82*l* of the waterway interface 76 are in fluid communication with openings 84*a*, 84*c* of the upper distribution member 70. In turn, these openings 84*a*, 84*c* are in fluid communication with runner 86*a* intermediate the upper distribution member 70 and the intermediate distribution member 74. Runner 86*a* is in fluid communication with connecting ports 88*a*, 88*b* and with the runner 90*a* between the intermediate distribution member 74 and the lower distribution member 72. As such, outlets 92*a*-92*d* are open and in fluid communication with corresponding outlets 46*a*-46*d* at the sprayface 64.

As may be appreciated, the various modes of operation detailed above provide for different active outlet 46 configurations at the sprayface 64. Furthermore, such different outlet 46 configurations provide different cross-sectional flow areas for the dispensing of water. Such varying flow areas at substantially constant pressure will result in different forces being imparted by the dispensed water. While six different modes of operation are illustrated herein, it should be noted that the number of modes may vary.

With reference now to FIGS. 24-37, a further illustrative sprayhead 112 is illustrated. The sprayhead 112 includes many similar components to sprayhead 12 of FIGS. 1-23. As such, in the following description like reference numbers will be used to identify similar components to those detailed above.

The sprayhead 112 illustratively includes an outer shell 138 receiving a waterway 140. The waterway 140 includes a threaded inlet 142 fluidly coupled to the outlet tube 32. Check valves 43 may be supported downstream from the inlet 142. A mode diverter 144 is supported by the waterway 140 and is configured to toggle or alternate between a spray mode and a stream mode. In the spray mode, water is dispersed through outlet openings 146 in a sprayface 148. In a stream mode, water is dispensed through the aerator 50. A spray diverter 152 is coupled to the shell 138 and is positioned downstream from the mode diverter 144. The spray diverter 152 operates only in the spray mode and is configured to change the cumulative cross-sectional flow area of the outlet openings 146 dispensing water through the sprayface 148.

Figure 25:
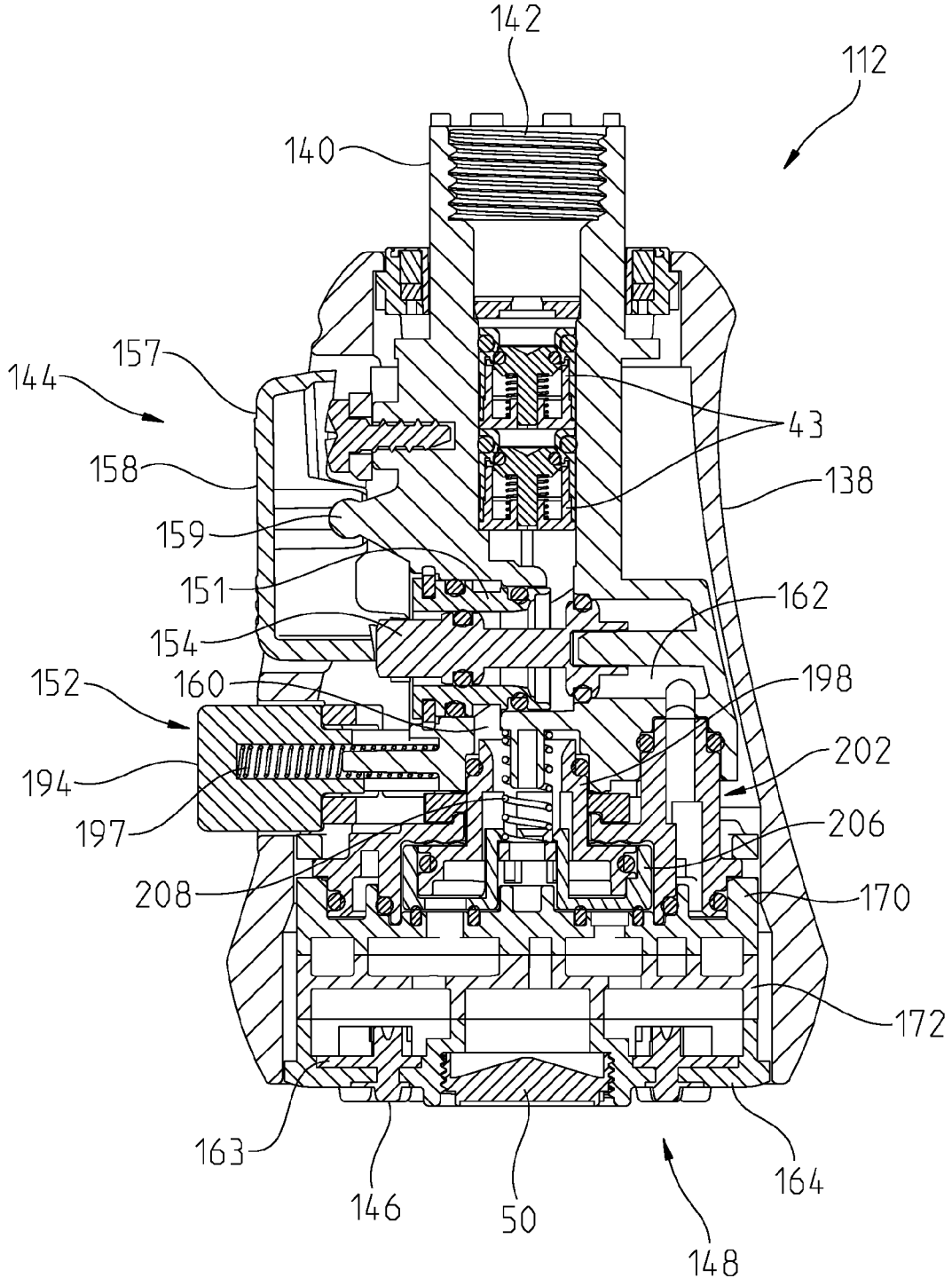
FIG. 25 is a cross-sectional view taken along line 25-25 of FIG. 24.
Figure 26:
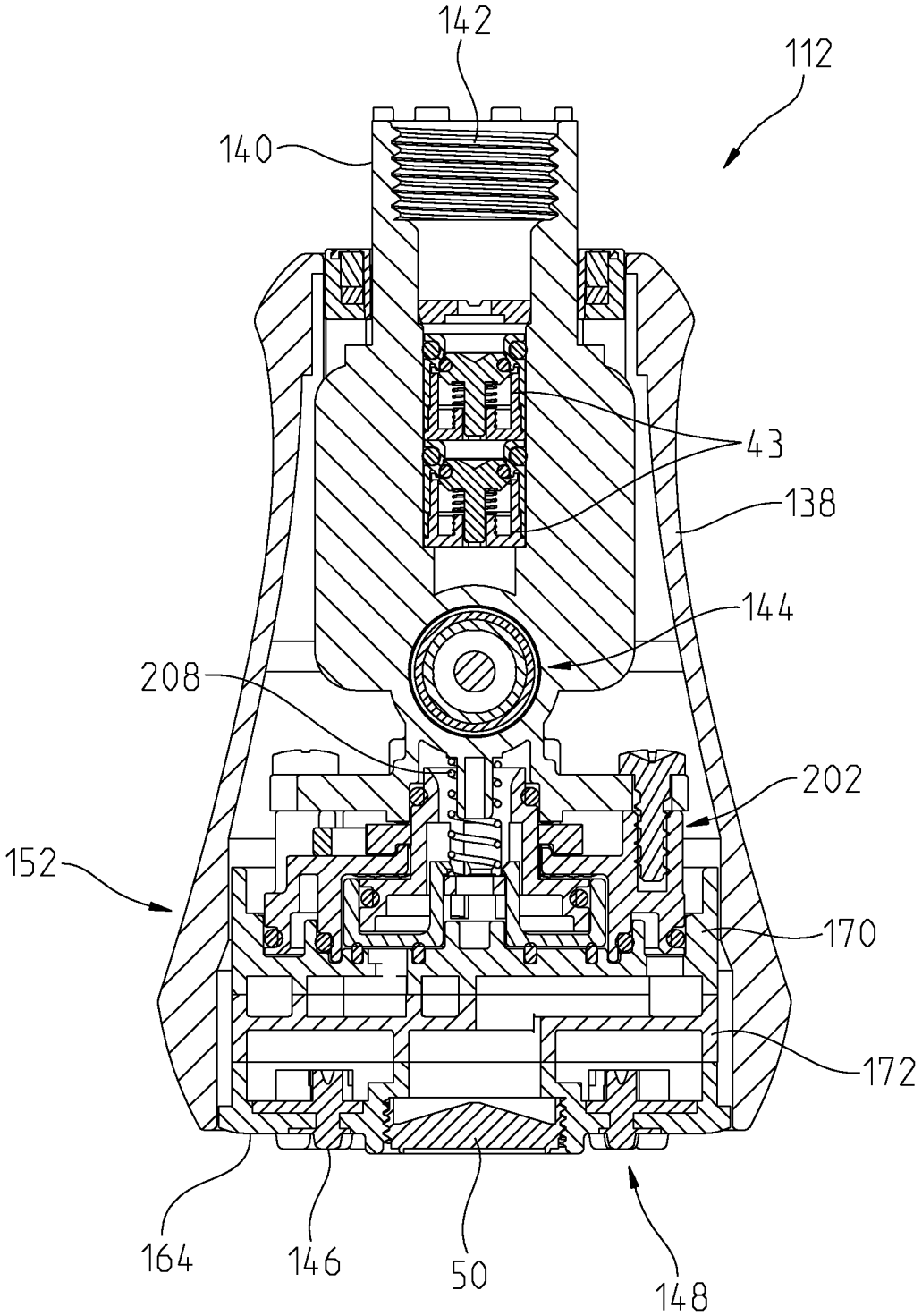
FIG. 26 is a cross-sectional view taken along line 26-26 of FIG. 24.
Figure 27:
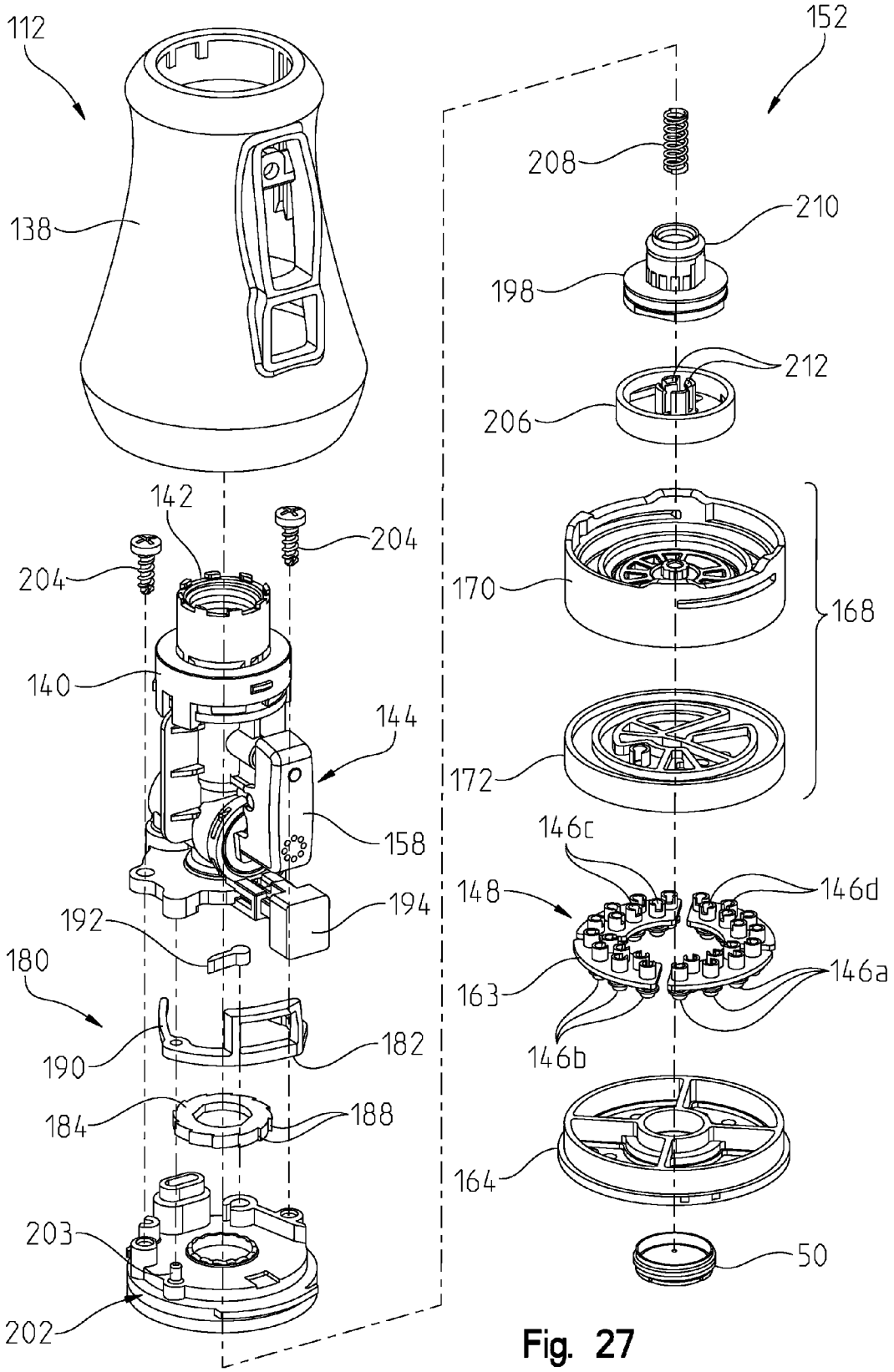
FIG. 27 is an upper exploded perspective view of the sprayhead of FIG. 24.
Figure 28:
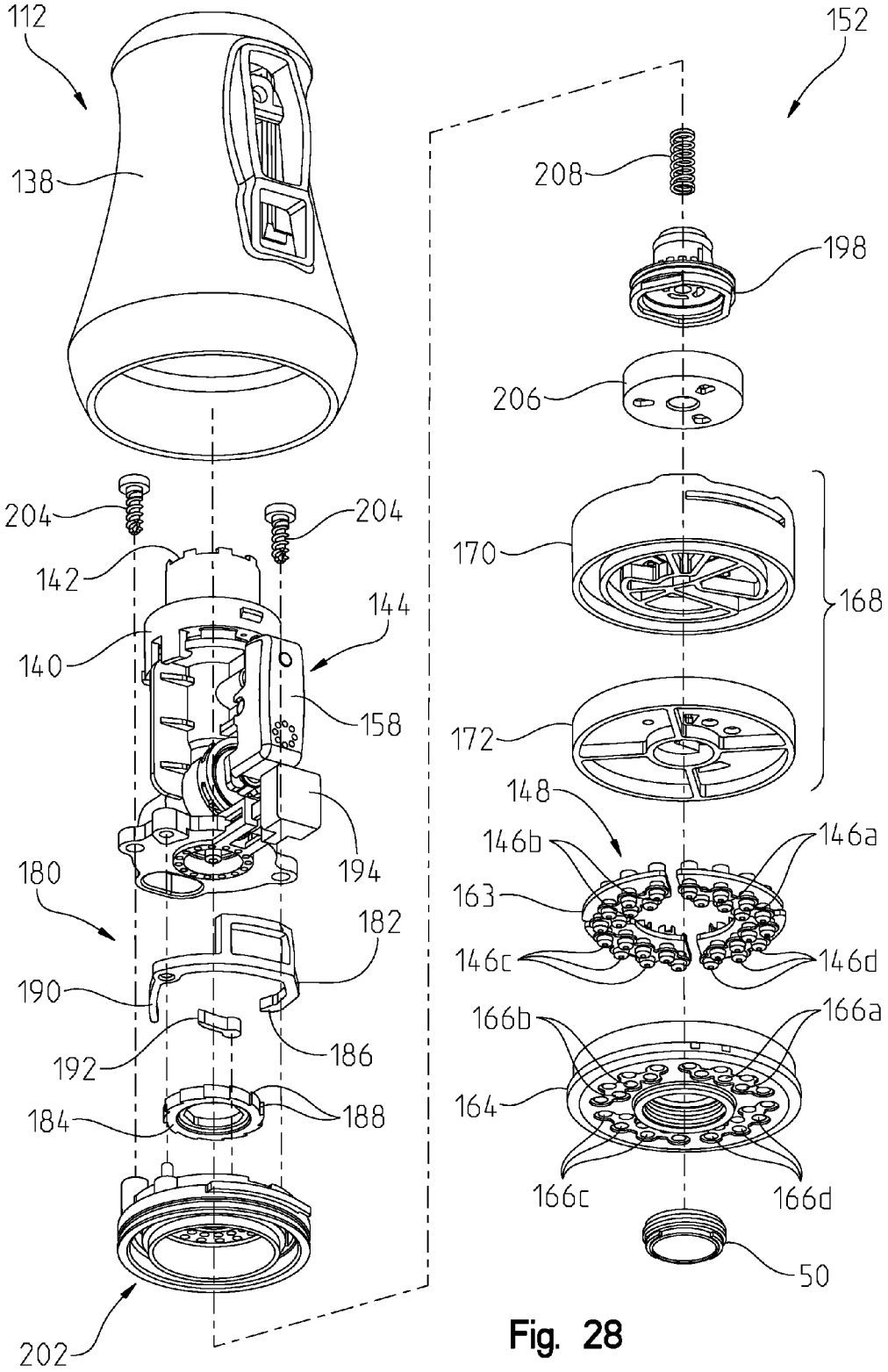
FIG. 28 is a lower exploded perspective view of the sprayhead of FIG. 24.
Figure 29:
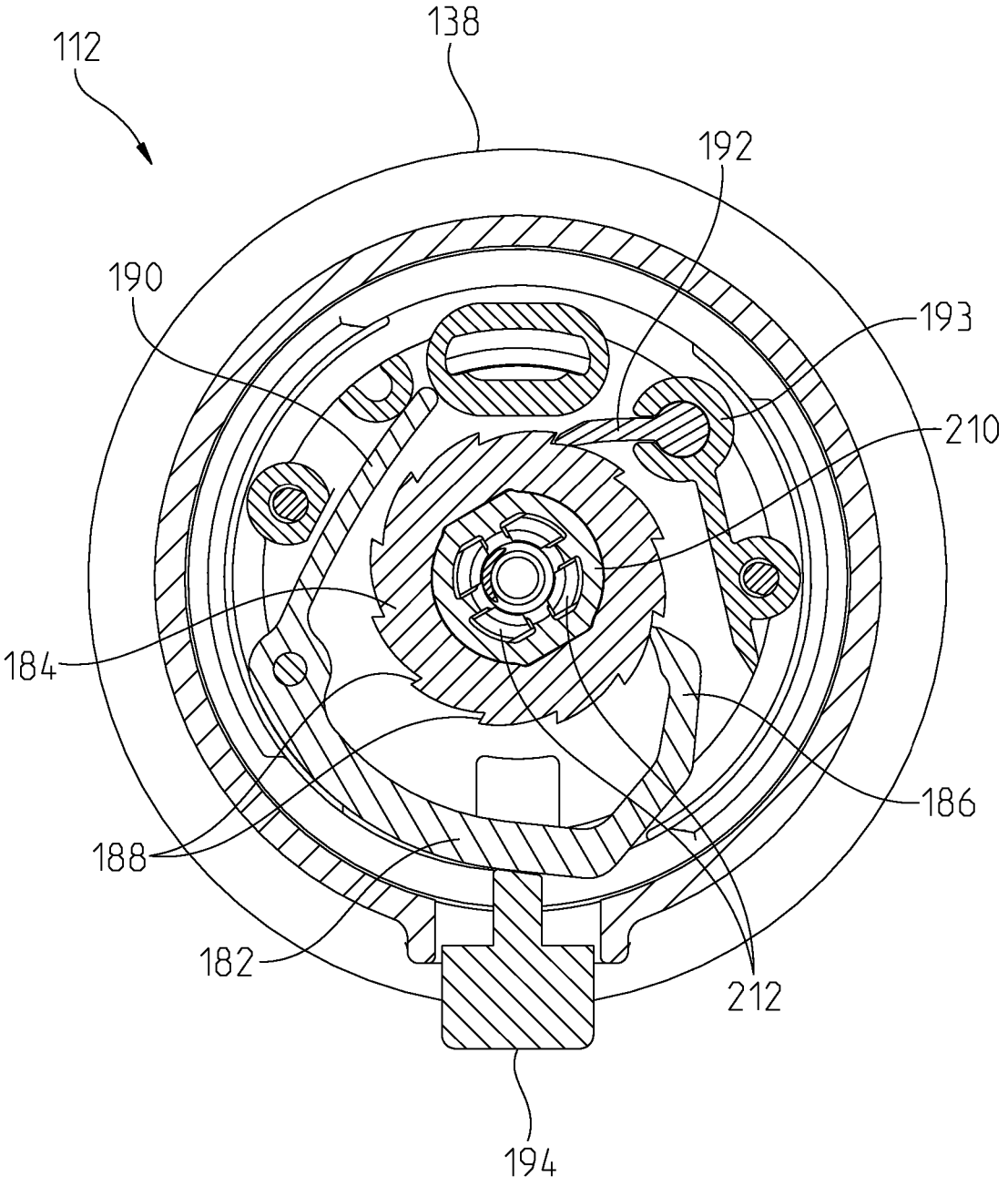
FIG. 29 is a cross-sectional view taken along line 28-28 of FIG. 24.
Figure 30:
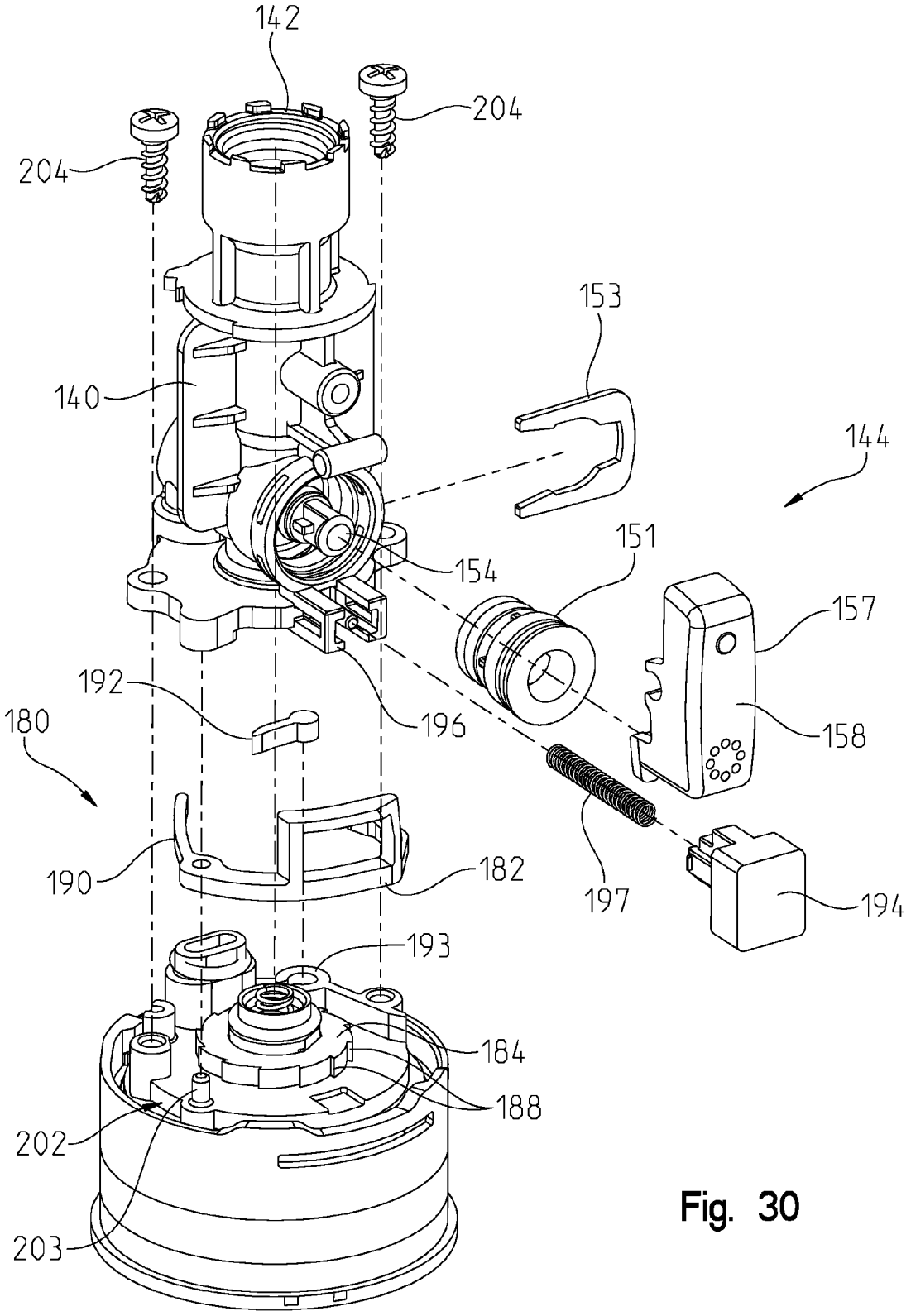
FIG. 30 is a detailed exploded perspective view of the sprayhead of FIG. 24, showing the waterway, the spray diverter, and the sprayface.
Figure 32:
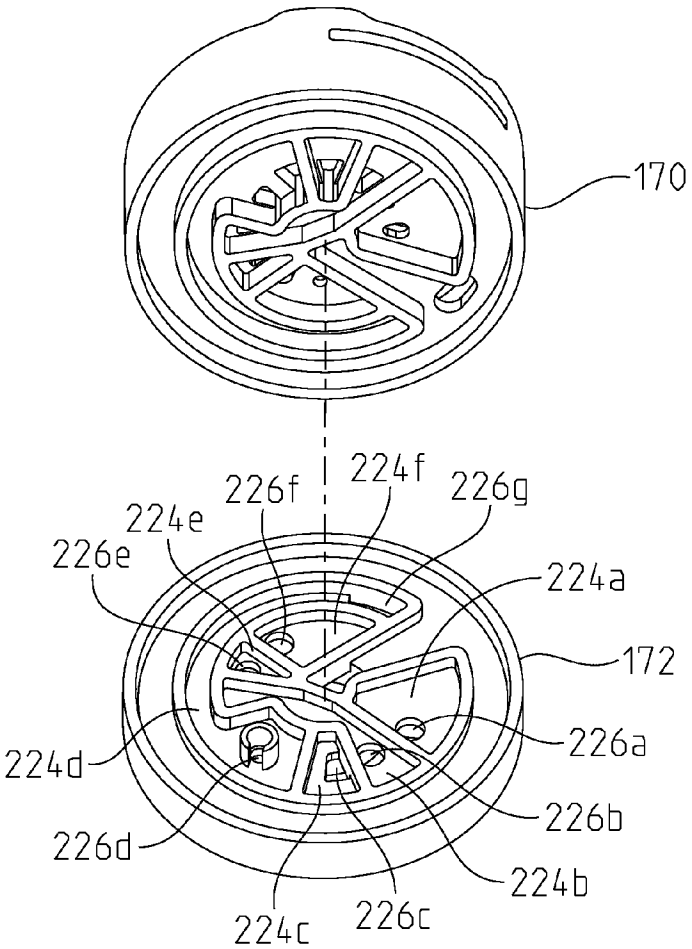
FIG. 32 is a detailed exploded perspective view of the sprayhead of FIG. 24, showing the upper distribution member and the lower distribution member.
Figure 31:
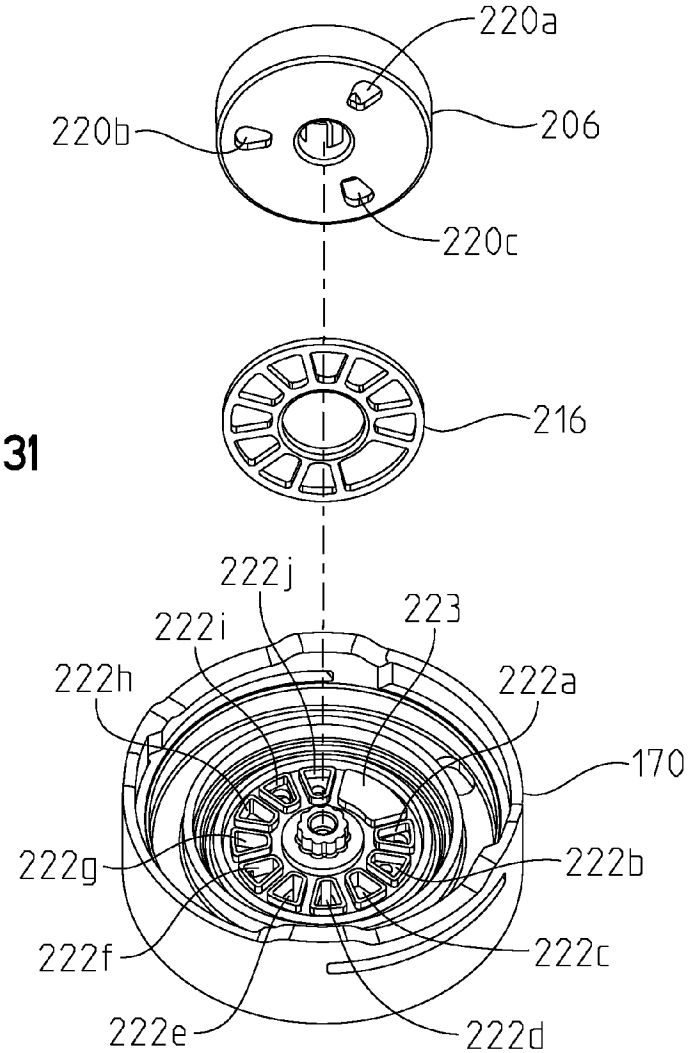
FIG. 31 is a detailed exploded perspective view of the sprayhead of FIG. 24, showing the interface plate and the upper distribution member.
Figure 33:
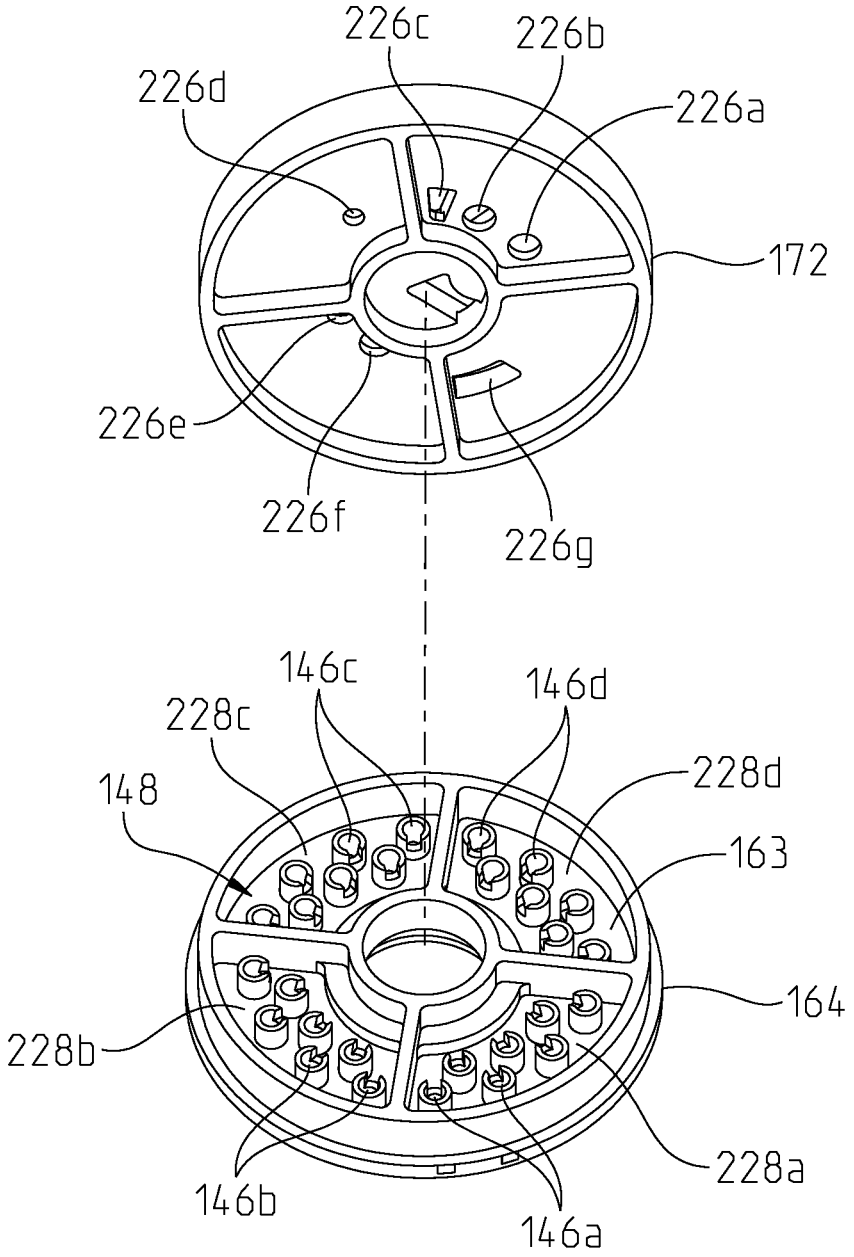
FIG. 33 is a detailed exploded perspective view of the sprayhead of FIG. 24, showing the lower distribution member and the sprayface.

With reference to FIGS. 25 and 26, the mode diverter 144 may be of conventional design and similar to that detailed above as mode diverter 44. A toggle switch 158 is operably coupled to a piston 154. The toggle switch 158 may include a rocker button 157 supported for rocking or pivoting movement about a pivot ball 159. User input to the toggle switch 158 causes the piston 154 to alternate between the spray mode and the stream mode. In a first position, the piston 154 directs water from the inlet 142 through a passageway 160 to the aerator 50 (i.e., stream mode). In a second position, the piston 154 directs water to a second chamber 162 and to the spray diverter 152 (i.e., spray mode).

The sprayface 148 illustratively includes an annular body or ring 163 supporting outlet openings or nozzles 146. In one embodiment, the ring 163 is divided into four (4) sets of nozzles 146*a*, 146*b*, 146*c*, 146*d*. A holder 164 receives the ring 163 such that nozzles 146 extend within openings 166. In the illustrative embodiment, the outlet openings 146 are circumferentially spaced apart from each other in the pattern of an annular ring.

With reference now to FIGS. 27-33, the spray diverter 152 illustratively includes a distribution assembly 168 including an upper distribution member 170 and a lower distribution member or plate 172. The upper distribution member 170 is configured to rotationally interface with an interface member or plate 206 supported by the waterway 140. A drive mechanism 180 is supported by the lower end of the waterway 140 and includes a carrier 198 supported for rotation within a support 202. The carrier 198 is operably coupled to a ratchet 184 including a plurality of teeth 188. An actuator 182 is operably coupled to the ratchet 184 and includes a pawl 186 and a leaf spring 190.

A lock 192 is supported within a receiver 193 for pivoting movement relative to the support 202. A push button 194 is operably coupled to the drive mechanism 180 to cause the pawl 186 to engage the ratchet teeth 188 and incrementally drive the ratchet 184 in rotation (counter-clockwise in FIG. 29). The lock 192 secures the ratchet 184 in the advanced or indexed position and prevents backwards rotation (clockwise in FIG. 29). Each tooth 188 is illustratively spaced by approximately 30°, such that each engagement of the actuator 182 with the ratchet 184 causes corresponding rotation by approximately 30°.

Fingers 212 of the carrier 198 extend upwardly into the ratchet 184 such that rotation of the ratchet 184 causes similar rotation of the carrier 198 and the interface member 206. As such, continued actuation of button 194 causes successive incremental rotation of the ratchet 184, carrier 198 and interface member 206.

Figure 34:
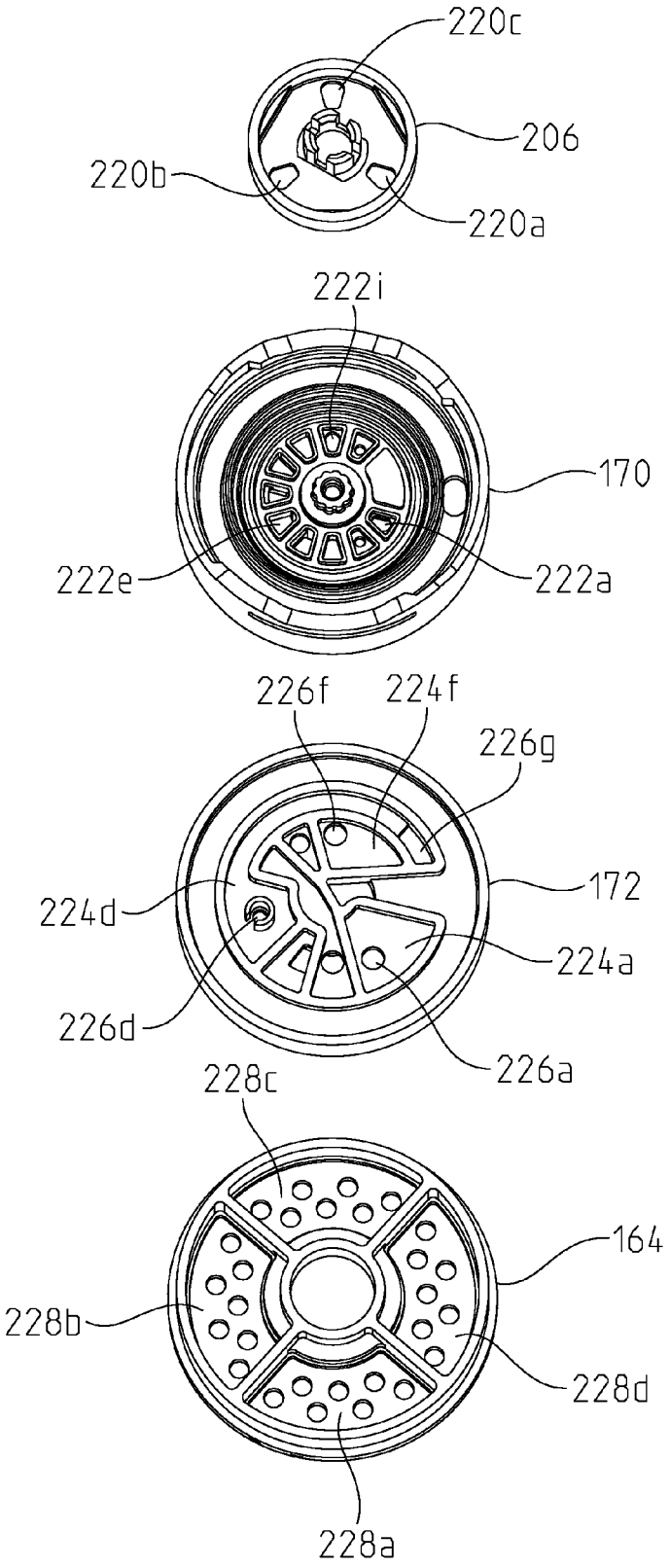
FIG. 34 is an upper perspective view illustrating the rotational spray diverter in a first mode.

With further reference now to FIGS. 34-37, various angular positions and associated modes of operation of the spray diverter 152 are shown. In different modes of operation, various circumferential groups of openings 146 in the sprayface 148 may be active or dispensing water. FIG. 34 represents the spray diverter 152 in a first mode of operation where all openings 146 of the sprayface 148 are open with a high flow rate of water dispensed therefrom. The interface member 206 is oriented such that openings 220*a*, 220*b*, 220*c* are in fluid communication with openings 222*a*, 222*e*, 222*i* of the upper distribution member 170, respectively. Openings 222*a*, 222*e*, 222*i* are in fluid communication with runners 224*a*, 224*d*, 224*f* intermediate the upper distribution member 170 and the lower distribution member 172. Runners 224*a*, 224*d*, 224*f* are in fluid communication with chambers 228*a*-228*d* of the holder 164 of sprayface 148 through openings 226*a*, 226*d*, 226*f*, 226*g*. All of the openings 146*a*, 146*b*, 146*c*, 146*d* of the sprayface 148 are open.

Figure 35:
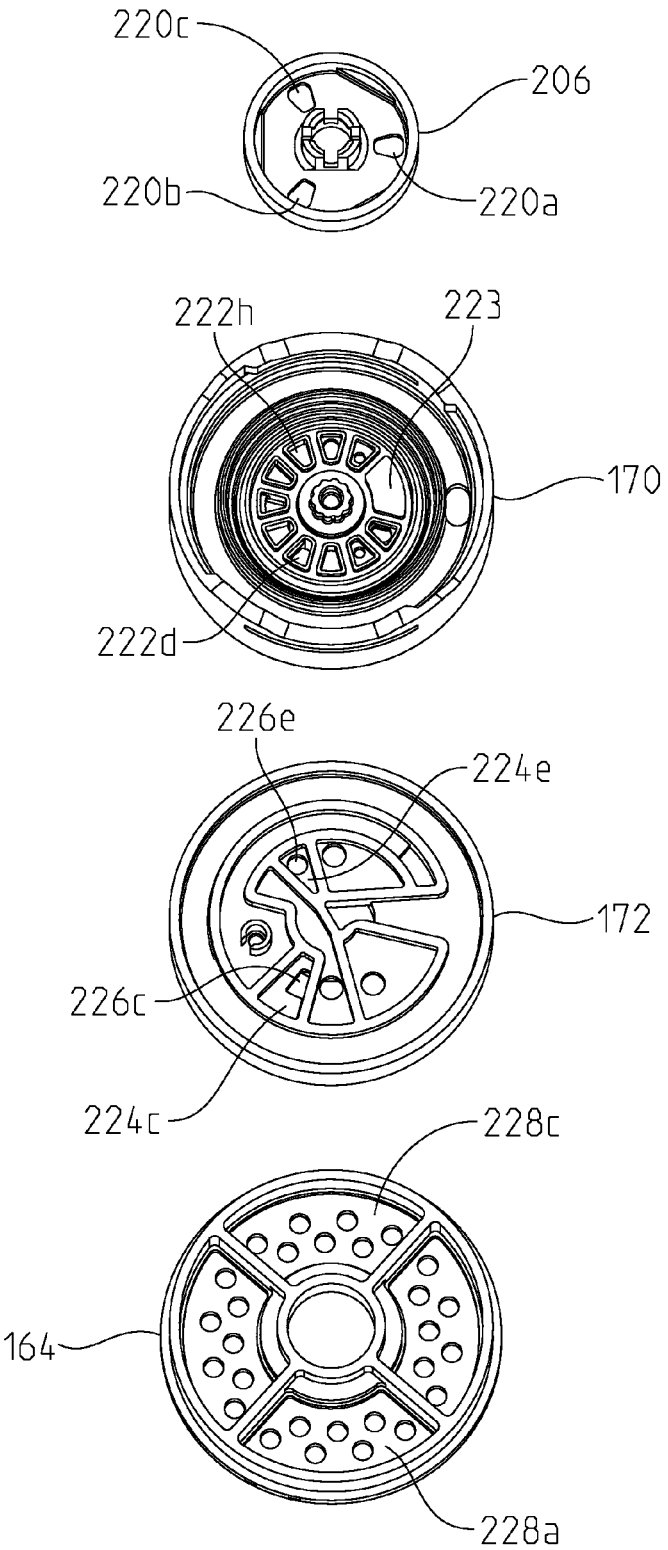
FIG. 35 is an upper perspective view illustrating the rotational spray diverter in a second mode.

With reference to FIG. 35, a second mode of operation is shown where interface member 206 is rotated counterclockwise by approximately 30 degrees from the position of FIG. 34. In this position, the spray diverter 152 provides for select openings 146*a* and 146*c* in the sprayface 148 to be open. The interface member 206 is oriented such that openings 220*b*, 220*c* are in fluid communication with openings 222*d*, 222*h* of the upper distribution member 170, respectively. Openings 222*d*, 222*h* are in fluid communication with runners 224*c*, 224*e*, intermediate the upper distribution member 170 and the lower distribution member 172. Runners 224*c*, 224*e* are in fluid communication with chambers 228*a*, 228*c* of the holder 164 of sprayface 148 through openings 226*c*, 226*e*. Openings 146*a*, 146*c* of the sprayface 148 are open.

Figure 36:
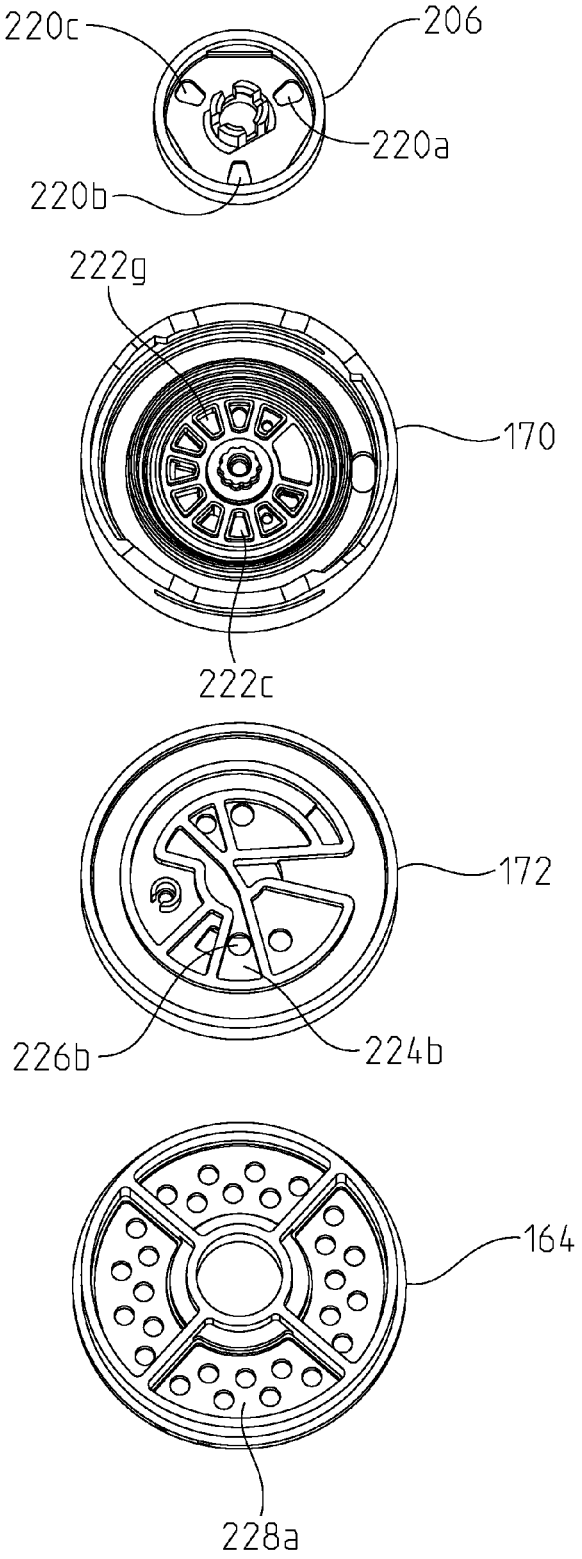
FIG. 36 is an upper perspective view illustrating the rotational spray diverter in a third mode.

With reference to FIG. 36, a third mode of operation is shown where interface member 206 is rotated counterclockwise by approximately 30 degrees from the position of FIG. 35. As such, the total rotation of the interface member 206 is approximately 60 degrees counterclockwise from the position of FIG. 34. The interface member 206 is oriented such that openings 220*b*, 220*c* are in fluid communication with openings 222*c*, 222*g* of the upper distribution member 170, respectively. Openings 222*c*, 222*g* are in fluid communication with runner 224*b* intermediate the upper distribution member 170 and the lower distribution member 172. Runners 224*b* is in fluid communication with chamber 228*a* of the holder 164 of sprayface 148 through opening 226*b*. Openings 146*a* of the sprayface 148 are open.

Figure 37:
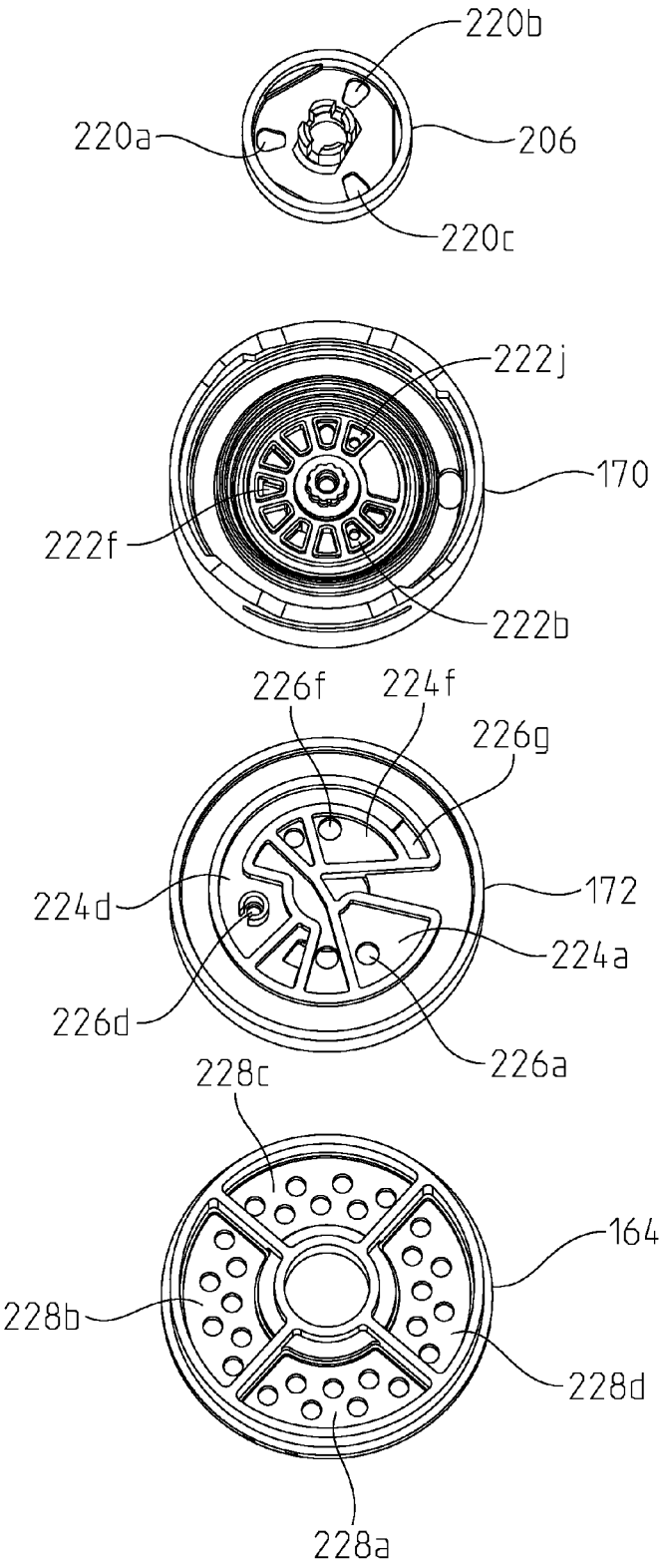
FIG. 37 is an upper perspective view illustrating the rotational spray diverter in a fourth mode.

FIG. 37 illustrates a fourth mode of operation, where interface member 206 is rotated counterclockwise by approximately 30 degrees from the position of FIG. 36. As such, the total rotation of the interface member 206 is approximately 90 degrees counterclockwise from the position of FIG. 34. The interface member 206 is oriented such that openings 220*a*, 220*b*, 220*c* are in fluid communication with openings 222*b*, 222*f*, 222*j* of the upper distribution member 170, respectively. Openings 222*b*, 222*f*, 222*j* are in fluid communication with runners 224*a*, 224*d*, 224*f* intermediate the upper distribution member 170 and the lower distribution member 172. Runners 224*a*, 224*d*, 224*f* are in fluid communication with chambers 228*a*-228*d* of the holder 164 of sprayface 148 through openings 226*a*, 226*d*, 226*f*, 226*g*. All of the openings 146*a*, 146*b*, 146*c*, 146*d* of the sprayface 148 are open but at a lower flow rate than the first mode of operation.

Although the invention has been described in detail with reference to certain preferred embodiments, variations and modifications exist within the spirit and scope of the invention as described and defined in the following claims.

The invention claimed is:

1. A faucet wand assembly comprising:

a shell;

a waterway received within the shell, the waterway including an inlet and an outlet;

a sprayface in fluid communication with the waterway, the sprayface including a plurality of water outlets, the plurality of water outlets including at least one stream outlet and a plurality of spray outlets;

a mode diverter operably coupled to the waterway and configured to change water flow through the sprayface from a stream mode to a spray mode, the stream mode defined when water is discharged through the at least one stream outlet, and the spray mode defined when water is discharged through at least some of the plurality of spray outlets; and a spray diverter operably coupled to the waterway downstream from the mode diverter, the spray diverter being configured to change the open water outlets in the spray mode, wherein the spray diverter is positioned adjacent the sprayface intermediate the mode diverter and the sprayface;

wherein the spray diverter is supported for rotation about the waterway; and wherein the spray diverter includes a distribution assembly including a plurality of inlet ports, a plurality of outlet ports, and a plurality of runners fluidly connecting the inlet ports and the outlet ports.

2. The faucet wand assembly of claim 1, wherein the spray diverter changes the cumulative flow area of open water outlets in the sprayface and resulting velocity of water dispensed from the sprayface.

3. The faucet wand assembly of claim 1, wherein the mode diverter includes a piston configured to toggle between the stream mode and the spray mode.

4. The faucet wand assembly of claim 1, wherein the distribution assembly includes an upper distribution member, a lower distribution member, and an intermediate distribution member, a plurality of first runners defined intermediate the upper distribution member and the intermediate distribution member, and a plurality of second runners defined intermediate the intermediate distribution member and the lower distribution member.

5. The faucet wand assembly of claim 1, wherein the spray diverter includes a first spray mode where a first set of water outlets in the sprayface are open, a second spray mode where a second set of water outlets are open, and a third spray mode where a third set of water outlets are open, the number of open water outlets in the first set being greater than the number of open water outlets in the second set, and the number of open water outlets in the second set being greater than the number of open water outlets in the third set.

6. The faucet wand assembly of claim 5, wherein the spray diverter includes a fourth spray mode where the first set of water outlets in the sprayface are open, the first spray mode at a different flow rate than the fourth spray mode.

7. A faucet wand assembly comprising:

a shell;

a waterway received within the shell and including an inlet and an interface member including a plurality of interface openings;

a sprayface fluidly coupled to the waterway, the sprayface including a plurality of water outlets, the plurality of water outlets including at least one stream outlet and a plurality of spray outlets;

a mode diverter operably coupled to the waterway and configured to change water flow through the sprayface from a stream mode to a spray mode, the stream mode defined when water is discharged through the at least one stream outlet, and the spray mode defined when water is discharged through at least some of the plurality of spray outlets; and a rotational spray diverter operably coupled to the waterway, the rotational spray diverter including a distribution member downstream from the interface member including a plurality of distribution inlet ports, a plurality of distribution outlet ports, and a plurality of runners fluidly coupling the distribution inlet ports and the distribution outlet ports, wherein the distribution member is configured to rotate relative to the interface member of the waterway, the distribution inlet ports are selectively aligned with different interface openings as the distribution member rotates relative to the interface member, wherein the spray diverter is positioned adjacent the sprayface intermediate the mode diverter and the sprayface.

8. The faucet wand assembly of claim 7, wherein the mode diverter includes a piston configured to toggle between the stream mode and the spray mode.

9. The faucet wand assembly of claim 7, wherein the distribution assembly includes an upper distribution member, a lower distribution member, and an intermediate distribution member, a plurality of first runners defined intermediate the upper distribution member and the intermediate distribution member, and a plurality of second runners defined intermediate the intermediate distribution member and the lower distribution member.

10. The faucet wand assembly of claim 7, wherein the spray diverter includes a first mode where a first set of water outlets in the sprayface are open, a second mode where a second set of water outlets are open, and a third mode where a third set of water outlets are open, the number of open water outlets in the first set being greater than the number of open water outlets in the second set, and the number of open water outlets in the second set being greater than the number of open water outlets in the third set.

11. The faucet wand assembly of claim 10, wherein the spray diverter includes a fourth mode where the first set of water outlets in the sprayface are open, the first spray mode at a different flow rate than the fourth spray mode.

12. The faucet wand assembly of claim 10, wherein the rotational spray diverter further includes a detent pin configured to releasably retain the distribution assembly in each of the modes.

13. A faucet wand assembly comprising:

a waterway;

a sprayface in fluid communication with the waterway;

a mode diverter including a piston received within the waterway for sliding movement transverse to the waterway, and a button operably coupled to the piston to toggle water flow through the sprayface between a spray mode and a stream mode; and a rotational spray diverter positioned downstream of the mode diverter and rotatable relative to the waterway, wherein the spray diverter in a first rotational orientation is in a first spray mode where a first set of water outlets in the sprayface are open, in a second rotational orientation is in a second spray mode where a second set of water outlets in the sprayface are open, and in a third rotational orientation is in a third spray mode where a third set of water outlets in the sprayface are open, the number of open water outlets in the first set being greater than the number of open water outlets in the second set, and the number of open water outlets in the second set being greater than the number of open water outlets in the third set.

14. The faucet wand assembly of claim 13, wherein the spray diverter includes a distribution assembly including a plurality of inlet ports, a plurality of outlet ports, and a plurality of runners fluidly connecting the inlet ports and the outlet ports.

15. The faucet wand assembly of claim 14, wherein the distribution assembly includes an upper distribution member, a lower distribution member, and an intermediate distribution member, a plurality of first runners defined intermediate the upper distribution member and the intermediate distribution member, and a plurality of second runners defined intermediate the intermediate distribution member and the lower distribution member.

16. The faucet wand assembly of claim 13, wherein the spray diverter changes the cumulative flow area of active water outlets in the sprayface and resulting velocity of water dispensed from the sprayhead.

17. The faucet wand assembly of claim 13, wherein the spray diverter in a fourth rotational orientation is in a fourth spray mode where the first set of water outlets in the sprayface are open, the first spray mode at a different flow rate than the fourth spray mode.

* * * * *